US009248655B2

(12) United States Patent
Nose

(10) Patent No.: US 9,248,655 B2
(45) Date of Patent: Feb. 2, 2016

(54) LIQUID CONTAINER

(75) Inventor: Hiroshi Nose, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/238,458

(22) PCT Filed: Aug. 23, 2012

(86) PCT No.: PCT/JP2012/005298

§ 371 (c)(1),
(2), (4) Date: May 20, 2014

(87) PCT Pub. No.: WO2013/027410

PCT Pub. Date: Feb. 28, 2013

(65) Prior Publication Data

US 2014/0247296 A1 Sep. 4, 2014

(30) Foreign Application Priority Data

Aug. 24, 2011 (JP) ..... 2011-182250
May 31, 2012 (JP) ..... 2012-124160

(51) Int. Cl.
*B41J 2/175* (2006.01)
*B41J 29/38* (2006.01)
*B41J 2/17* (2006.01)

(52) U.S. Cl.
CPC ..... *B41J 2/17503* (2013.01); *B41J 2/1753* (2013.01); *B41J 2/17513* (2013.01); *B41J 2/17553* (2013.01); *B41J 2/17566* (2013.01)

(58) Field of Classification Search
CPC ..... B41J 2/17566; B41J 2/1752; B41J 2/175; B41J 2/17553; B41J 2/17523; B41J 2/17526; B41J 2/17509; B41J 2/17503
USPC ..... 347/6, 7, 84, 85, 86
See application file for complete search history.

(56) References Cited

U.S. PATENT DOCUMENTS 6,502,917 B1 1/2003 Shinada et al.
6,634,738 B1 10/2003 Shinada et al.

(Continued)

FOREIGN PATENT DOCUMENTS

EP 1547781 A2 6/2005
EP 1757452 A1 2/2007

(Continued)

OTHER PUBLICATIONS

International Search Report and Written Opinion of the International Searching Authority dated Dec. 12, 2012 issued in International Application No. PCT/JP2012/005298.

*Primary Examiner* — Jannelle M Lebron
(74) *Attorney, Agent, or Firm* — Stroock & Stroock & Lavan LLP

(57) ABSTRACT

In the liquid container which includes the detection member having a liquid outlet, a contact portion, and an input receiving unit, the liquid outlet and the input receiving unit of the detection member are provided at a position apart from each other on the same bottom surface, and the contact portion is provided in the opposite side to the side where the input receiving unit is provided. It is possible to suppress foreign substances from becoming attached to the input section by providing the input receiving unit at the position apart from the any one of the liquid outlet and the contact portion since the liquid outlet and the contact portion have a section where foreign substances (liquid and chips) are easily generated.

5 Claims, 18 Drawing Sheets

(56) References Cited

U.S. PATENT DOCUMENTS

| | | | | |
|---|---|---|---|---|
| 7,237,881 | B2 | 7/2007 | Hayasaki et al. | |
| 7,293,865 | B2 | 11/2007 | Tsukuda et al. | |
| 7,841,711 | B2 * | 11/2010 | Matsumoto et al. | 347/86 |
| 8,091,995 | B2 | 1/2012 | Shimizu et al. | |
| 2002/0085075 | A1 | 7/2002 | Shinada et al. | |
| 2002/0158948 | A1 * | 10/2002 | Miyazawa et al. | 347/86 |
| 2005/0151811 | A1 * | 7/2005 | Shimizu et al. | 347/86 |

FOREIGN PATENT DOCUMENTS

| | | | |
|---|---|---|---|
| JP | 2001-180003 | A | 7/2001 |
| JP | 2005-178362 | A | 7/2005 |
| JP | 2009-132157 | A | 6/2009 |
| WO | 2008/056487 | A | 5/2008 |

* cited by examiner

LIQUID CONTAINER

TECHNICAL FIELD

The present invention relates to a liquid container which is mounted in a liquid ejecting apparatus (also referred to as a liquid consuming apparatus) that ejects liquid and which accommodates liquid therein.

BACKGROUND ART

In general, a liquid container such as an ink cartridge which accommodates liquid therein as a liquid source is installed in a liquid ejecting apparatus which ejects liquid such as ink from ejection nozzles like an ink jet printer. The liquid container is detachably installed to the liquid ejecting apparatus, and the liquid is supplied to the liquid container from a liquid supply port. When the liquid in the liquid container has been expended, a new liquid container can replace the liquid container.

With the purpose of informing a user of replacement time of the liquid container (when the liquid in the liquid container has been expended), technology that a rectangular prism is provided on a bottom portion of the liquid container, and the liquid in the liquid container can be detected by using a light emitting element and a light receiving element provided in the liquid ejecting apparatus main body has been proposed (For example, PTL 1). In the technology, light which enters an incident surface of the prism from the light emitting element to, and is transmitted into the liquid container in a state in which the liquid in the liquid container is sufficient. On the other hand, when the liquid in the liquid container is consumed and the prism is exposed from the liquid, the light of the light emitting element which enters the incident surface of the prism is reflected by a boundary surface between the prism and air in the liquid container to reach the light receiving element. Accordingly, it is possible to detect the remaining liquid amount in the liquid container based on whether the light receiving element receives the light of the light emitting element.

In the liquid container disclosed in PTL 1, a contact portion is provided on a side surface of the liquid container, and when the liquid container is mounted in the liquid ejecting apparatus, the contact portion of the liquid container and a connection unit of the liquid ejecting apparatus main body side are electrically connected to each other.

CITATION LIST

Patent Literature

PTL 1: JP-A-2009-132157

SUMMARY OF INVENTION

Technical Problem

However, in the above-described liquid container in the related art, there is a problem that foreign substances such as ink are attached to the incident surface of the prism in some cases. As a result, there is a problem that the light which enters the prism (or the light which exits from the prism) is blocked by the foreign substances and it is difficult to detect the remaining liquid amount in the liquid container. Without being limited to the liquid container which detects the remaining liquid amount in the liquid container by using the prism, the same problem can be generated by the attachment of foreign substances to an input section to a member for detection (a detecting member) in a liquid container which detects a remaining liquid amount by receiving an input to the member for detection provided in the liquid container from outside.

The liquid container includes a liquid accommodation unit which accommodates liquid and is arranged with a prism, and a liquid conducting channel which communicates with the liquid accommodation unit to make the liquid in the liquid accommodation unit flow outside (the liquid ejecting apparatus) in some cases. Herein, in a mounting state in which the liquid container is mounted in the liquid ejecting apparatus, the liquid container is inclined from a proper posture which is originally designed (the right posture) due to vibration from outside and external force applied at the time of mounting in some cases. When the liquid container is inclined from the right posture, a state that the liquid is eccentrically present in a side where the prism is positioned in the liquid accommodation unit, and the liquid is not present in a side of the liquid accommodation unit with which the liquid conducting channel communicates (also referred to as a "first state") can occur. When the liquid container is in the first state, for example, the liquid container is inclined, and the prism is immersed into the liquid regardless of the liquid accommodation unit accommodating the liquid just with an amount of degree of exposing the prism in the right posture. Accordingly, although the liquid ejecting apparatus detects the remaining liquid amount to "liquid remains", there is a concern that the liquid may not be sufficiently supplied to the liquid conducting channel from the liquid accommodation unit. When the liquid is not sufficiently supplied to the liquid conducting channel from the liquid accommodation unit, an irregularity such as a so-called air shot which is a phenomenon that the liquid is not discharged often occurs in spite of the liquid consuming apparatus performing a liquid discharging operation.

Such problems are not limited to the liquid container which detects the remaining liquid amount in the liquid container by using the prism, and also occur in the liquid container which includes a detection member used to detect the remaining liquid amount by receiving an input from outside.

When the liquid container deviates from the right posture and is mounted in the liquid ejecting apparatus, a positional deviation of the prism to the liquid ejecting apparatus is generated, and the detection accuracy of the remaining liquid amount in the liquid container using the liquid ejecting apparatus is lowered in some cases.

Such problems are not limited to a liquid container which detects the remaining liquid amount in the liquid container by using a prism, and also occur in a liquid container which includes a detection member used to detect the remaining liquid amount by receiving an input from outside.

The invention is made to solve at least a part of the problems in the related art, and the first object is to provide technology capable of suppressing foreign substances from becoming attached to an input section to a detection member in a liquid container which detects the remaining liquid amount therein by using the detection member such as a prism. In the mounted state where the liquid container is mounted in a liquid ejecting apparatus, the second object is to provide technology capable of suppressing the liquid container from deviating from the right posture. In the mounted state where the liquid container is mounted in the liquid ejecting apparatus, the third object is to provide technology capable of suppressing the positional deviation of the detection member to the liquid ejecting apparatus.

Solution to Problem

Accordingly, it is an object of the present invention to provide a liquid container which employs the following configuration. That is, the liquid container which has a bottom surface which is flatly formed and a first side surface which extends from one end of the bottom surface in a longitudinal direction, and which can accommodate liquid in a liquid accommodation unit and is detachably mounted in a liquid consuming apparatus including a liquid outlet which makes liquid in the liquid accommodation unit flow to the outside of the liquid container; a contact portion which is electrically connected to the liquid consuming apparatus by mounting the liquid container in the liquid consuming apparatus; and a detection member which has an input receiving unit provided on the bottom surface to receive an input from outside, and is provided to be able to come into contact with the liquid accommodated in the liquid accommodation unit, and in which response to the input to the input receiving unit changes depending on a surface state of a side which comes into contact with the liquid in the liquid accommodation unit, in which the contact portion is provided on the first side surface, the liquid outlet is provided to be close to the one end of the bottom surface, and the input receiving unit is provided to be close to other end in the longitudinal direction of the bottom surface.

When the liquid container is mounted in and detached from the liquid consuming apparatus, there is liquid leakage around the liquid outlet. From the viewpoint of securing the electrical connection between the contact portion and the liquid consuming apparatus, since the contact portion and a member of the liquid consuming apparatus side are rubbed each other at the time of mounting and detaching the liquid container, chips of the contact portion or the liquid consuming apparatus side member are generated. In the liquid container of the present invention, the liquid outlet and the input receiving unit are provided at a position apart from each other on the same bottom surface, and the contact portion is provided on the first side surface which extends from an end of the bottom surface opposite to a side where the input receiving unit is provided. For this reason, it is possible to suppress liquid from the liquid outlet and chips generated in the contact portion from becoming attached to the input receiving unit. As a result, the input to the detection member from outside is blocked due to the foreign substance attachment, and the detection accuracy of the remaining liquid amount in the liquid container can be suppressed from being lowered.

The input to the input receiving unit of the liquid container of the present invention is set to light, and a prism where a reflection state of light input to the input receiving unit changes on the basis of whether a detection section which is a light path comes into contact with the liquid in the liquid container may be used as the detection member.

By doing this, it is possible to detect whether the liquid remains by the position of the detection section of the detection member in the liquid accommodation unit in a non-contacting method. By using a cheap prism as the detection member, the liquid container can be manufactured at a low price. Although a member which makes the light enter the detection member in the liquid consuming apparatus side, and a member which detects the reflected light from the detection member are needed, since the members are not so expensive, manufacturing costs does not increase for the liquid consuming apparatus as a whole.

In the above-described liquid container of the present invention, a concave portion may be formed on the bottom surface of the liquid container, and the input receiving unit may be provided in the concave portion.

By doing this, since the input receiving unit is arranged in a back position from the bottom surface of the liquid container (a position where foreign substances are difficult to intrude), effect of suppressing the foreign substances (liquid and chips) from becoming attached to the input receiving unit can be increased. When the input receiving unit is arranged at such position, contact of the input receiving unit with fingers of the user and attachment of finger prints can be suppressed at the time of mounting and detaching the liquid container. As a result, the detection accuracy of the remaining liquid amount in the liquid container can be further suppressed from being lowered by foreign substances.

In the above-described liquid container of the present invention, a convex portion may be formed on the bottom surface of the liquid container, and the liquid outlet may be provided in the convex portion.

When the liquid outlet is arranged at such position, it is possible to have a longer distance from the liquid outlet to the input receiving unit than a case that the liquid outlet is provided on the bottom surface of the liquid container. Due to this, it is possible to further suppress the liquid from becoming attached to the input receiving unit, thereby further suppressing the detection accuracy of the remaining liquid amount from being lowered by foreign substances.

The above-described liquid container of the present invention may further include a liquid conducting channel in which a communication port which is one end is connected to the liquid accommodation unit, and other end is the liquid outlet, and which makes the liquid accommodated in the liquid accommodation unit flow to the liquid outlet, and a protrusion which is provided at a position closer to the other end than the one end of the bottom surface, and the communication port may be provided at a position closer to the one end than the detection member in the longitudinal direction.

In the liquid container, the protrusion is provided at the position closer to the other end than the one end of the bottom surface. Due to this, even when the liquid container tries to move so that the one end of the bottom surface is positioned in an upper side and the other end is positioned in a lower side in the mounted state where the liquid container is mounted in the liquid consuming apparatus, in comparison with the time of the right posture of the liquid container, the protrusion abuts onto the liquid consuming apparatus to control the movement of the liquid container. For this reason, it is possible to suppress the liquid container from being inclined from the right posture to be a first state.

In the above-described liquid container of the present invention, the protrusion may be provided at a position closer to the other end of the bottom surface than the detection member.

According to the liquid container, the protrusion is provided at a position closer to the other end than the detection member. Due to this, even when the liquid container tries to move by a strong external force so that the one end of the bottom surface is positioned in the upper side and the other end is positioned in the lower side in comparison with when the liquid container is in the right posture, the protrusion abuts onto the liquid consuming apparatus to more stably control the movement of the liquid container. Therefore, it is possible to further suppress the liquid container from being inclined from the right posture to be the first state.

The above-described liquid container of the present invention may further include a second side surface which extends from the other end of the bottom surface to face the first side surface, and the second side surface may be provided with a side protrusion. According to the liquid container, in comparison with when the liquid container is in the right posture, even when the liquid container tries to move so that other end of the bottom surface is positioned in the lower side, the side protrusion abuts onto the liquid consuming apparatus to further control the movement of the liquid container. Therefore, it is possible to further suppress the liquid container from being inclined from the right posture to be the first state.

The above-described liquid container of the present invention may include a liquid supply unit in which the liquid outlet is formed in an end, and extends from the position closer to the one end than the other end of the bottom surface.

According to the liquid container, in comparison with when the liquid container is in the right posture, even when the liquid container tries to move so that the one end of the bottom surface is positioned in the lower side and the other end is positioned in the upper side, the liquid supply unit abuts onto the liquid consuming apparatus to control the movement of the liquid container. Therefore, it is possible to further suppress the liquid container from being inclined from the right posture.

In the above-described liquid container of the present invention, an elastic member which is provided on the first surface to be used when the liquid container is mounted and detached in the liquid consuming apparatus, and which makes the first side surface biased to a direction toward the other end from the one end when the liquid container is mounted in the liquid consuming apparatus may be provided. According to the liquid container, it is possible to push the liquid container to the liquid consuming apparatus by the elastic member. For this reason, a possibility of relatively moving the liquid container by external force to the liquid consuming apparatus can be lowered. In the mounted state, even when the liquid container moves in the direction where the elastic member is compressed, it is possible to return the liquid container to the right posture by the elastic member.

In the above-described liquid container of the present invention, the liquid outlet may be inserted into a liquid acquisition needle of the liquid consuming apparatus when the liquid container is mounted in the liquid consuming apparatus, the detection member has a triangular prism which includes the surface, the triangular prism may be provided with a ridge line forming an apex so as to extend along the longitudinal direction, and a virtual surface which includes the ridge line and is perpendicular to the bottom surface may be provided so as to pass through the center of the liquid outlet. According to the liquid container, positioning of the liquid outlet to the liquid consuming apparatus is performed by inserting the liquid acquisition needle. By determining the position of the triangular prism in the liquid container on the basis of the liquid outlet which is positioned to the liquid consuming apparatus, the positional deviation of the triangular prism to the liquid consuming apparatus can be suppressed. That is, positioning the triangular prism to the liquid consuming apparatus can be precisely performed. In particular, since the liquid acquisition needle is inserted so as to pass through the center of the liquid outlet, it is difficult for the center of liquid outlet to generate the positional deviation to the liquid consuming apparatus in the liquid outlet. Therefore, by determining the position of the triangular prism in the liquid container on the basis of the center of the liquid outlet, the positional deviation of the triangular prism to the liquid consuming apparatus can be more suppressed.

The above-described liquid container of the present invention may further include a pair of container side control units which are provided on the first side surface to position the contact portion to the liquid consuming apparatus are positioned in both sides of the short direction on bottom surface to the contact portion, in which a contact portion surface which is a surface of the contact portion may be a plurality of container side terminals arranged in the short direction of the bottom surface and including a first container side terminal provided at a position of passing a center line on the surface of the contact portion in the short direction of the bottom surface, the detection member may have the triangular prism including the surface, and the triangular prism may be provided with the ridge line forming the apex so as to extend along the longitudinal direction, and the virtual surface which includes the ridge line and is perpendicular to the bottom surface may be provided so as to pass the first container side terminal.

According to the liquid container, the contact portion is positioned to the liquid consuming apparatus by the container side control unit. By determining the position of the triangular prism in the liquid container on the basis of the contact portion which is positioned to the liquid consuming apparatus, the positional deviation of the triangular prism to the liquid consuming apparatus can be suppressed. That is, positioning the triangular prism to the liquid consuming apparatus can be precisely performed. In particular, since the positioning of the contact portion to the liquid consuming apparatus is performed by the pair of container side control units positioned in both sides in the short direction with respect to the contact portion, it is difficult to generate the positional deviation in the section of the contact portion passing the center line. Therefore, by determining the position of the triangular prism in the liquid container on the basis of the first container side terminal which passes the center line of the contact portion, the positional deviation of the triangular prism to the liquid consuming apparatus can be more suppressed.

DESCRIPTION OF EMBODIMENTS

Hereinafter, embodiments will be described in the following order to easily understand the content of the invention described above.

A. First Embodiment

A-1. Apparatus Configuration:

A-2. Ink Cartridge Configuration of Embodiment:

A-3. Detection Method of Remaining Ink Amount:

B. Second Embodiment:

C. Modification Examples:

A. First Embodiment

A-1. Apparatus Configuration

Figure 1:
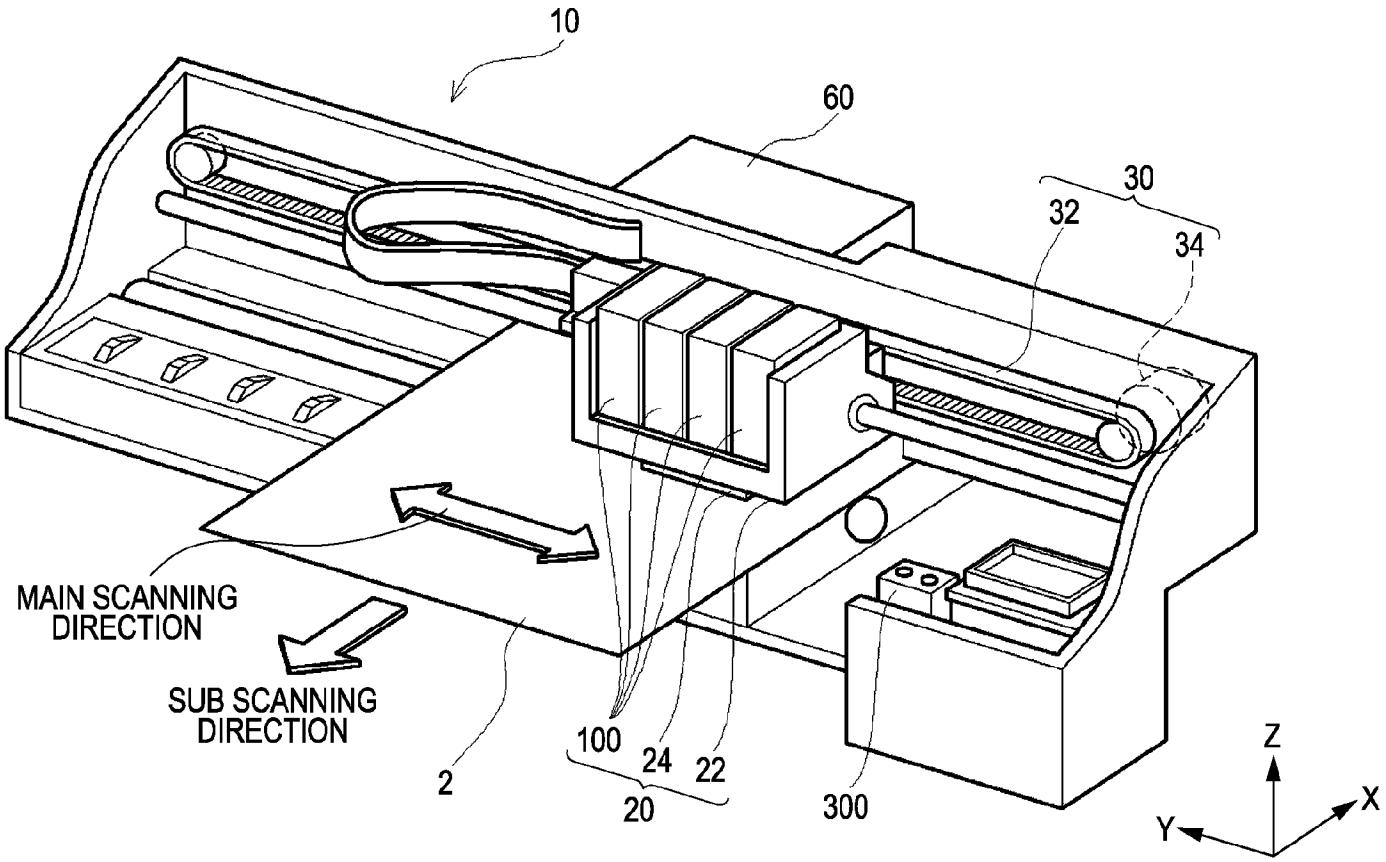
FIG. 1 is an illustrative view showing a brief configuration of a liquid ejecting apparatus of an embodiment.

FIG. 1 is an illustrative view showing a brief configuration of a liquid ejecting apparatus of an embodiment using a so-called ink jet printer as an example. X, Y, and Z axes which cross at right angles each other are attached to FIG. 1. X, Y, and Z axes are attached to subsequence drawings as necessary. As shown in the drawing, an ink jet printer 10 is configured by a carriage 20 which forms an ink dot on a printing medium 2 while reciprocating in a main scanning direction and a drive mechanism 30 which makes the carriage 20 reciprocate. An ink cartridge 100 (a liquid container) which accommodates ink, a carriage case 22 in which the ink cartridge 100 is mounted and an ejecting head 24 which ejects ink are provided in the carriage 20. A plurality of ejection nozzles are provide to a bottom surface side of the ejecting head 24 (a side which faces the printing medium 2) and ink in the ink cartridge 100 is guided by the ejecting head 24 to eject the ink from the ejection nozzles to the printing medium 2.

In the ink jet printer 10 shown in the drawing, a color image can be printed using four kinds of inks of cyan, magenta, yellow and black, and thereby, each ejection nozzle is provided for each kind of ink in the ejecting head 24. The ink is supplied to the each ejection nozzle through a supply passage (not shown) from the corresponding ink cartridge 100.

The drive mechanism 30 which makes the carriage 20 reciprocate is configured by a timing belt 32 where a plurality of tooth shapes are formed therein, and a driving motor 34 to drive the timing belt 32. A part of the timing belt 32 is fixed in the carriage case 22, and when the timing belt 32 is driven, it is possible for the carriage 20 to reciprocate in the main scanning direction as being guided by a guide rail extending in the main scanning direction.

A detection unit 300 to optically detect a remaining ink amount in the ink cartridge 100 is provided at a position other than a print region of the ink jet printer 10. In the detection unit 300 which will be described in detail later, a light emitting unit and a light receiving unit are provided, and when the ink cartridge 100 passes over the detection unit 300 according to the movement of the carriage 20, light is emitted from the light emitting unit, and the detection unit 300 detects the remaining ink amount in the ink cartridge 100 based on whether the light receiving unit receives the light. The detection unit 300 of the embodiment is set to be provided at a position other than the print region, but the detection unit 300 may be provided in the print region. Due to this, it is possible to detect the remaining ink amount without moving the carriage 20 a long distance in printing.

Furthermore, a control unit 60 which controls all operations of the ink jet printer 10 is installed on a back surface of the ink jet printer 10. The control unit 60 controls all operations such as the operation to make the ejecting head 24 reciprocate, the operation to eject the ink from the ejection nozzle, and the operation to detect the remaining ink amount in the ink cartridge 100.

A-2. Ink Cartridge Configuration of Embodiment

Figure 2A:
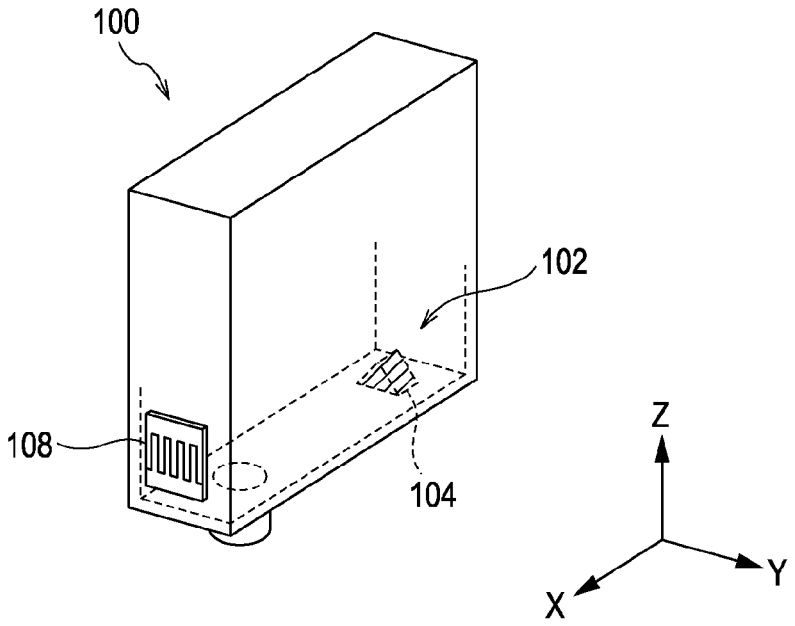
FIG. 2A is an illustrative view showing a structure of an ink cartridge of the embodiment.
Figure 2B:
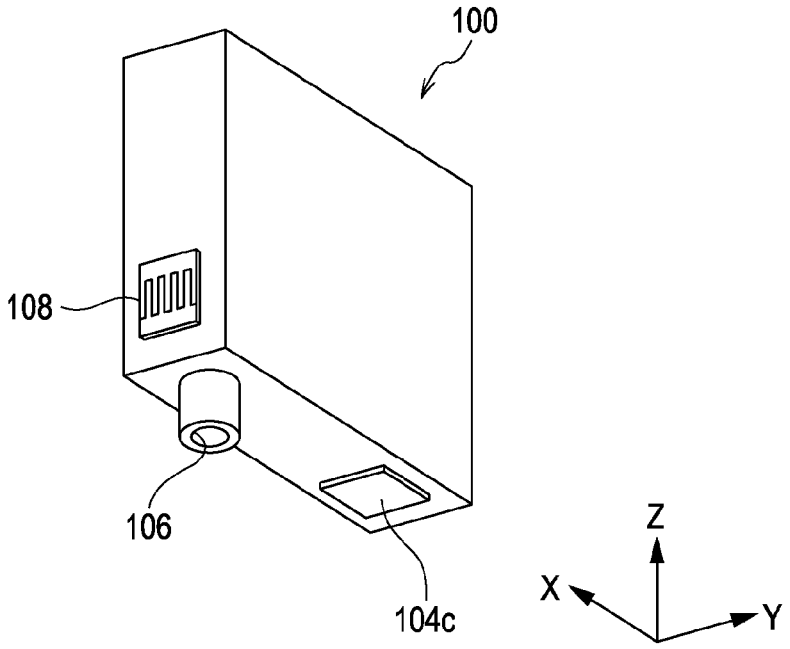
FIG. 2B is an illustrative view showing a structure of the ink cartridge of the embodiment.

FIG. 2A and FIG. 2B are perspective views showing a structure of the ink cartridge 100 of the embodiment. As shown in FIG. 2A, the ink cartridge 100 is a box body formed in a rectangular parallelepiped shape and the inside of the box body is an ink accommodating chamber 102 (a liquid accommodation unit) which accommodates ink therein. Although the ink cartridge 100 of the embodiment has the bottom surface formed in a rectangular shape, the shape of the bottom surface may not be a complete rectangular shape, and may be a flat shape with narrow width relative to length as a rectangular shape. Accordingly, for example, an elliptical cylinder shape in which the bottom surface is formed in a long and narrow elliptical shape may be employed as the ink cartridge shape.

A convex portion is provided on the bottom surface of the ink cartridge 100 in a near side of the drawing (a positive direction side of the X axis) and an ink supply port 106 (a liquid outlet) to supply the ink in the ink accommodating chamber 102 outside is provided in the convex portion. A substrate unit 108 which stores various kinds of information relating to the ink cartridge 100 is provided in the side surface of the ink cartridge 100 in the near side of the drawing (the positive direction side of the X axis). In addition, a prism 104 (a member used for detection) formed with plastic material having light transparency is provided on the bottom portion of the ink accommodating chamber 102 in a back side of the drawing (a negative direction of the X axis). The prism 104 is a so-called rectangular prism, and a part of the bottom surface of the ink cartridge 100 is configured with a bottom surface of the prism 104 (a light transmission surface 104*c*), as shown in FIG. 2B.

Figure 3:
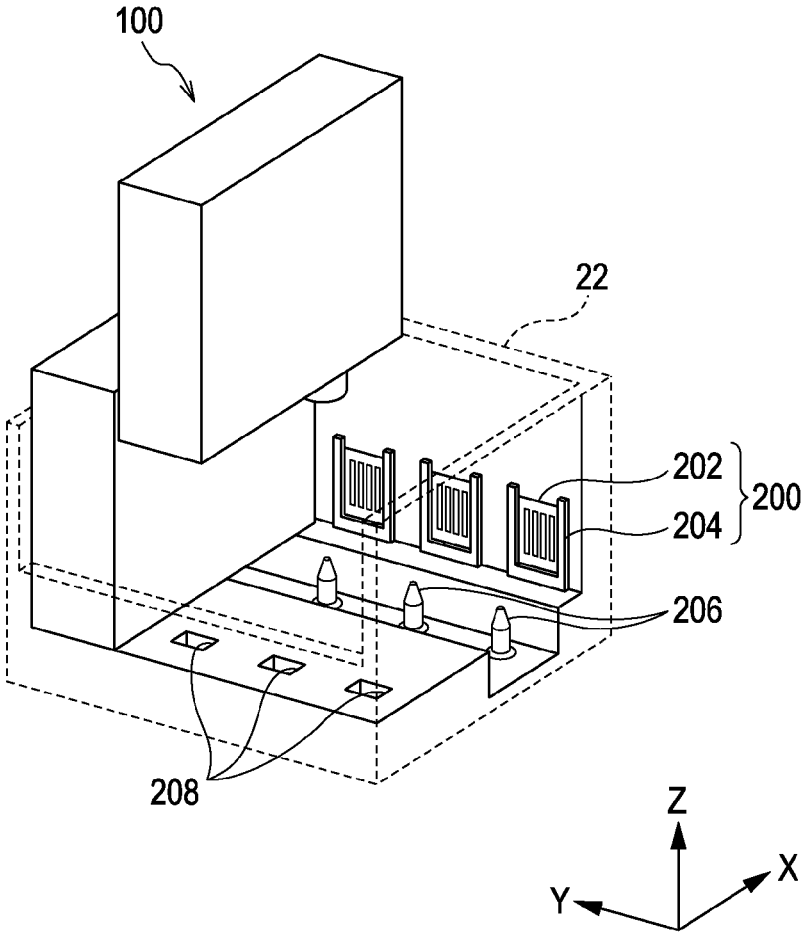
FIG. 3 is an illustrative view showing a structure of a carriage case in which the ink cartridge is mounted.

FIG. 3 is an illustrative view showing a structure of the carriage case 22 in which the ink cartridge 100 is mounted. As shown in the drawing, when the ink cartridge 100 is mounted in the carriage case 22 from the upward, each ink acquisition needle 206 vertically provided in the carriage case 22 is inserted into each ink supply port 106 and the ink in the ink cartridge 100 is trapped in an ink acquisition needle 206 to be supplied to the ejecting head 24. Through holes 208 are provided at a position corresponding to the prism 104 of the ink cartridge 100 in the carriage case 22. For this reason, when the ink cartridge 100 mounted in the carriage case 22 passes over a detection unit 300 in a region other than the print region (refer to FIG. 1), the light irradiated from the light emitting unit of the detection unit 300 enters the prism 104 through the through hole 208.

Furthermore, a connector unit 200 is provided on the surface of the carriage case 22 in the back side of the drawing. The connector unit 200 is configured with a connector 202 which is connected to the control unit 60 of the ink jet printer 10 and a holder 204 which holds the substrate unit 108 (not shown) of the ink cartridge 100 at the position of the connector 202. A surface of the substrate unit 108 is a contact portion which can be connected to the connector 202, and when the ink cartridge 100 is mounted in the carriage case 22, the substrate unit 108 and the connector 202 are rubbed and electrically connected each other. In the state, the substrate unit 108 of the ink cartridge 100 and the main body side of the ink jet printer 10 (control unit 60) are connected each other to exchange various kinds of information therebetween.

Since the ink cartridge 100 is mounted in the carriage case 22 (main body side of the ink jet printer 10) to be electrically connected to the connector 202, the substrate unit 108 of the embodiment corresponds to a "contact portion" in the invention. The substrate unit 108 is not limited to a member that is electrically connected to the main body side of the ink jet printer 10 to perform information exchange as described above, and includes a member which functions just as an electrical contact portion.

In the ink jet printer 10 configured in such a manner, the remaining ink amount in the ink cartridge 100 is detected by using the prism 104 provided in the ink cartridge 100 as follows.

A-3. Detection Method of Remaining Ink Amount

Figure 4A:
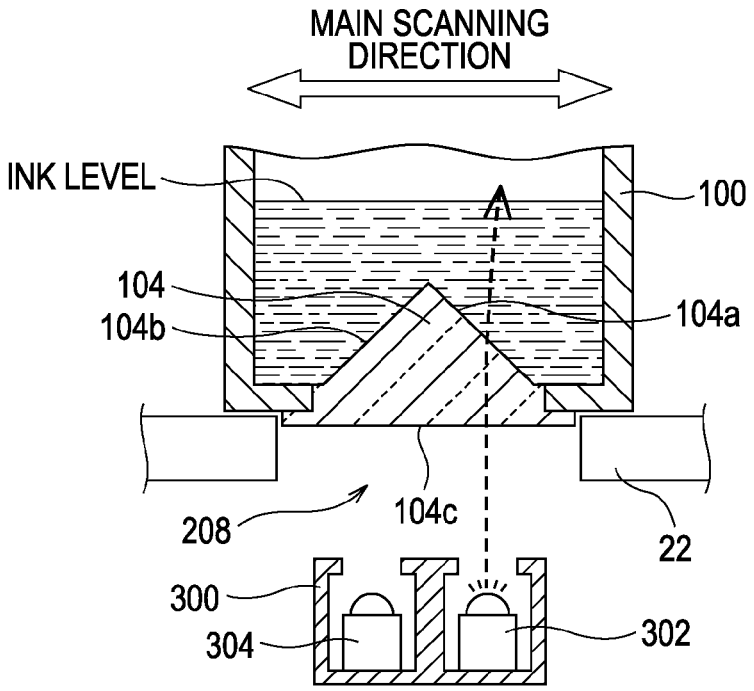
FIG. 4A is an illustrative view showing an aspect of detecting a remaining ink amount in the ink cartridge by using a prism.
Figure 4B:
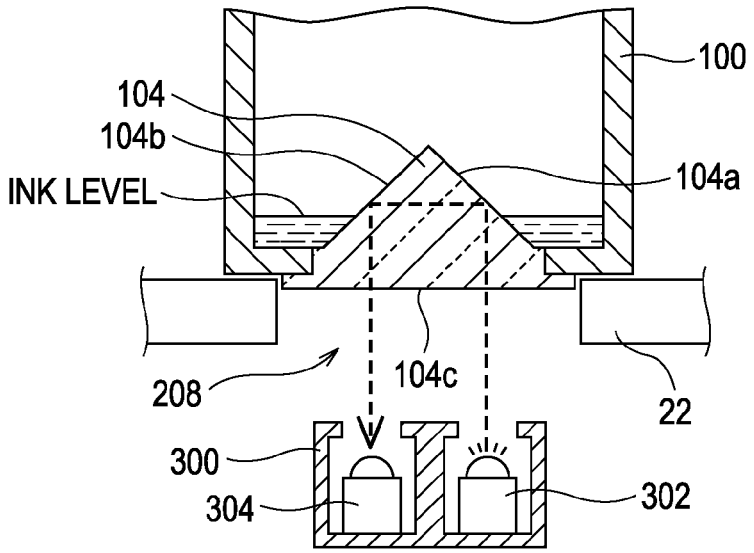
FIG. 4B is an illustrative view showing an aspect of detecting a remaining ink amount in the ink cartridge by using the prism.

FIGS. 4A and 4B are illustrative views showing aspects of detecting the remaining ink amount in the ink cartridge 100 by using a prism 104. First, the ink cartridge 100 is mounted in the carriage case 22 which reciprocates in the main scanning direction, as described above. In the mounted state, two surfaces (a first reflecting surface 104*a* and a second reflecting surface 104*b*) which have the same angle to the light transmission surface 104*c* are arranged in the main scanning direction in the prism 104 in the ink cartridge 100 as shown in FIGS. 4A and 4B. In the middle of the course that the carriage 20 moves in the main scanning direction, the detection unit 300 is provided at a downward position and a light emitting unit 302 which is configured by an infrared light-emitting diode and a light receiving unit 304 which is configured by a phototransistor are arranged in the detection unit 300 to the main scanning direction. According to the movement of the carriage 20, when the ink cartridge 100 passes over the detection unit 300, the light irradiated from the light emitting unit 302 passes through the through hole 208 of the carriage case 22 and perpendicularly enters the light transmission surface 104*c* (an input receiving unit) of the prism 104.

FIGS. 4A and 4B show a state in which the prism 104 in the ink cartridge 100 is positioned just on the detection unit 300, according to the movement of the carriage 20. At this time, as shown in FIG. 4A, when a liquid level of the ink (an ink level) in the ink cartridge 100 is over an apex of the prism 104, the first reflecting surface 104*a* and the second reflecting surface 104*b* come into contact with the ink. In this state, even when the light which enters the prism 104 from the light emitting unit 302 (the incident light) hits the first reflecting surface 104*a*, the light is not reflected and transmits the ink in the ink cartridge 100 as indicated by an arrow of a thick broken line in FIG. 4A. The light of the light emitting unit 302 does not reach the light receiving unit 304. In such case, the control unit 60 determines that the ink remains in the ink cartridge 100.

Meanwhile, when the ink in the ink cartridge 100 is consumed and the ink level is below the apex of the prism 104 as described in FIG. 4B, the first reflecting surface 104*a* and the second reflecting surface 104*b* in a section of the prism 104 which is exposed from the ink come into contact with air. When the ink in the ink cartridge 100 is reduced more than a predetermined amount so that the incident light hits the section where the first reflecting surface 104*a* comes into contact with air, the light is reflected as indicated by an arrow of a thick broken line in FIG. 4B. The light reflected by the first reflecting surface 104*a* hits the section where the second reflecting surface 104*b* comes into contact with air, and is reflected downward to reach the light receiving unit 304. In the case that light receiving unit 304 receives the reflected light from the prism 104, the control unit 60 determines that there remains little ink in the ink cartridge 100.

As described above, it can be said that the detection member (the prism 104) is a member used for optically detecting the remaining ink amount and the presence of the ink in the ink cartridge 100. Herein, optically detecting may be performed by a generally used light reflection type sensor or a light transmission type sensor. The sensor itself may be provided in the printer 10 side or be integrally formed with the ink cartridge 100.

Herein, in the ink cartridge which detects the remaining ink amount therein by using the prism as above, when foreign substances are attached to the light transmission surface of the prism, entering the light into the prism (or exiting the reflected light from the prism) is blocked by the foreign substances and thereby, detecting the remaining ink amount is difficult. On the contrary, in the ink cartridge 100 of the embodiment, it is suppressed that the foreign substances are attached to the light transmission surface 104*c* by providing the ink supply port 106, the substrate unit 108 and the light transmission surface 104*c* of the prism 104 to have a predetermined positional relationship.

Figure 5A:
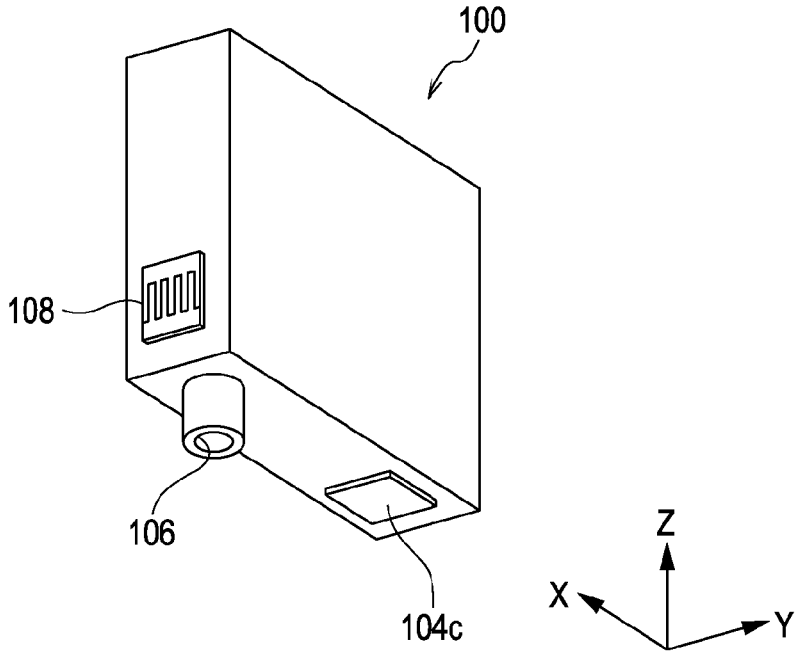
FIG. 5A is an illustrative view showing a reason that foreign substances are suppressed from becoming attached to a light transmission surface in ink cartridge of the embodiment.
Figure 5B:
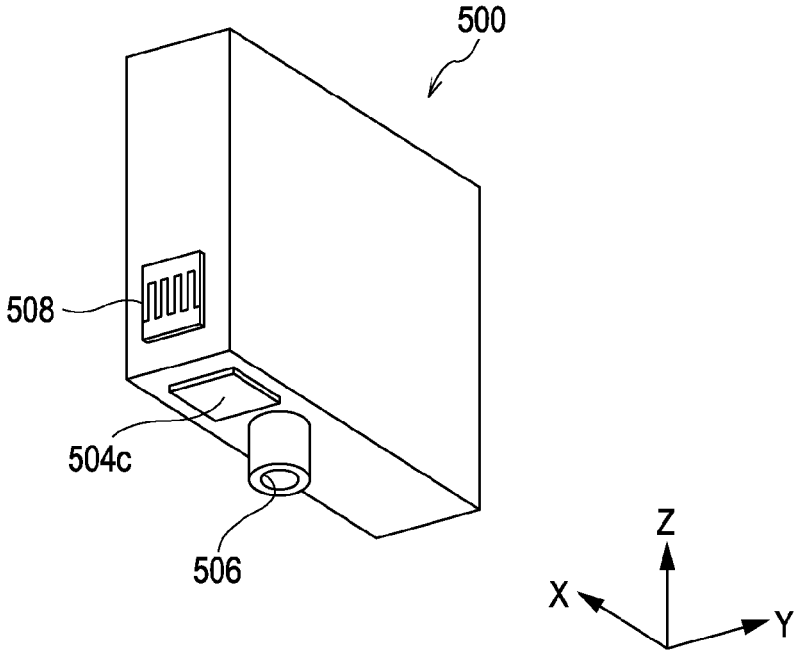
FIG. 5B is an illustrative view showing a reason that foreign substances are suppressed from becoming attached to a light transmission surface in an ink cartridge of the embodiment.

FIGS. 5A and 5B are illustrative views showing a reason that foreign substances are suppressed from becoming attached to the light transmission surface 104*c* in the ink cartridge 100 of the embodiment. FIG. 5A shows the positional relationship of the ink supply port 106, the substrate unit 108 and the light transmission surface 104*c* of the prism 104 in the ink cartridge 100 of the embodiment. FIG. 5B shows an example of an ink cartridge 500 according to a reference example where the ink supply port 106, the substrate unit 108 and the light transmission surface 104*c* are provided with a different positional relationship from the ink cartridge 100 in the embodiment.

First, to focus on the positional relationship between the ink supply ports 106 and 506 and the light transmission surfaces 104*c* and 504*c*, a distance between the ink supply port 106 and the light transmission surface 104*c* in the ink cartridge 100 of the embodiment is set to be larger than a distance between the ink supply port 506 and the light transmission surface 504*c* in the ink cartridge 500 of the reference example. Since the vicinity of each ink supply port 106 and 506 is a section to which the leaked ink is attached when the ink leaks out from the ink supply port at the time of detaching or mounting the ink cartridge and the like, it is possible to suppress the ink from becoming attached to the light transmission surface 104*c* by providing the ink supply port 106 at the distant position from the light transmission surface 104*c* as in the ink cartridge 100 of the embodiment in comparison with the ink cartridge 500 of the reference example in which the ink supply port is provided near the light transmission surface 104. As a result, since entering the light into the prism 104 (or exiting the light from the prism) is blocked by the ink, it is possible to suppress the detection of the remaining ink amount from being difficult.

To focus on the positional relationship between the substrate units 108 and 508 and the light transmission surfaces 104*c* and 504*c*, a distance between the substrate unit 108 and the light transmission surface 104*c* in the ink cartridge 100 of the embodiment is set to be larger than a distance between the substrate unit 508 and the light transmission surface 504*c* in the ink cartridge 500 of the reference example. The vicinity of each substrate unit 108 and 508 is a section where the contact portion of the each substrate units 108 and 508 and the connector 202 (refer to FIG. 3) are rubbing against each other to generate chips or the substrate units 108 and 508 and the holder 204 are in frictional contact to generate chips at the time of detaching or mounting the ink cartridge 100. Therefore, it is possible to suppress the chips from attaching to the light transmission surface 104*c* and to suppress the detection of the remaining ink amount from being difficult due to the chips in the ink cartridge 100 of the embodiment in which the substrate unit 108 is provided at the distant position from the light transmission surface 104*c* in comparison with the ink cartridge 500 of the reference example.

B. Second Embodiment

B-1. Configuration of Carriage Case 22*a*

Figure 6:
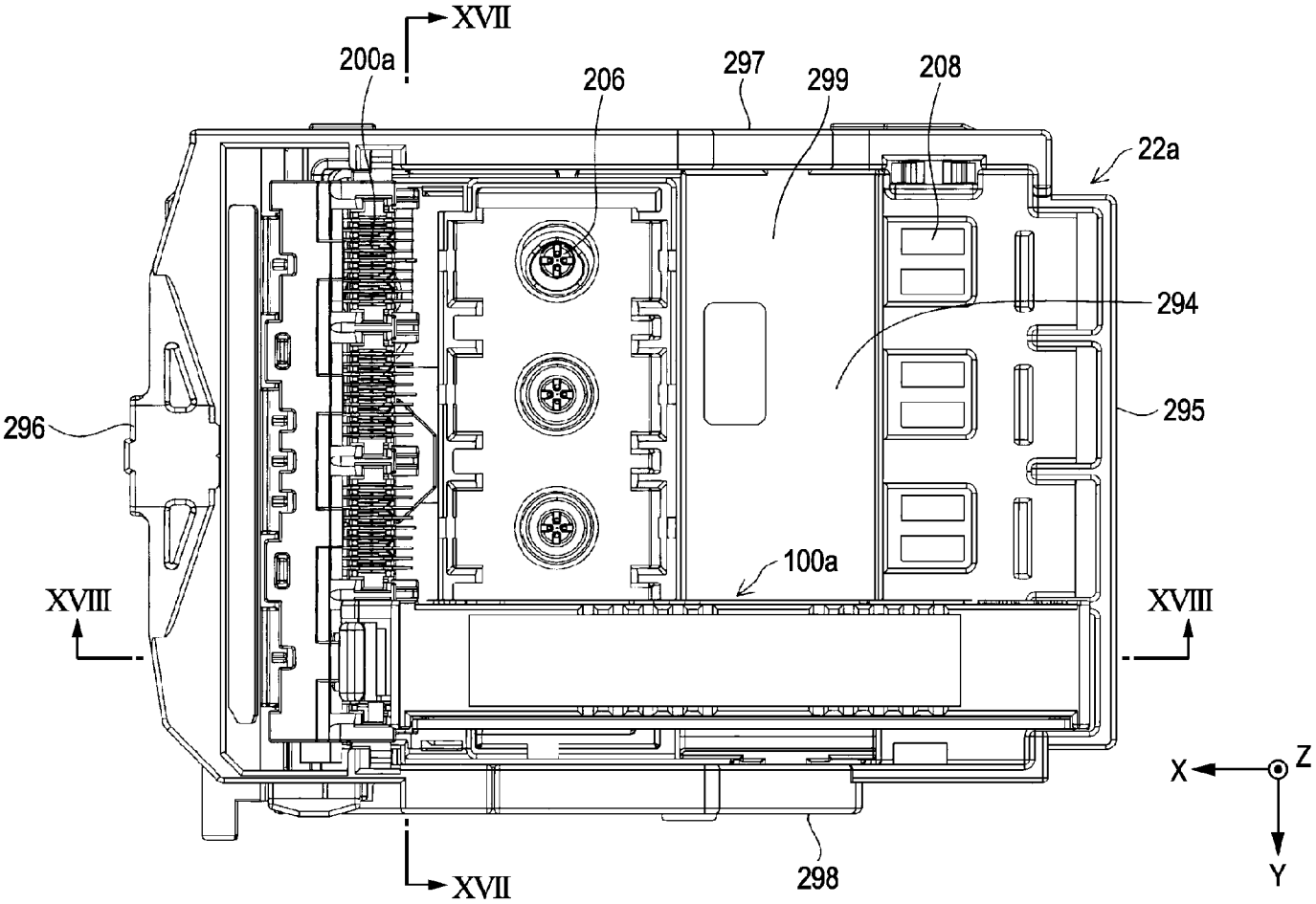
FIG. 6 is an illustrative view showing a light transmission surface installation aspect of an ink cartridge of a second embodiment.
Figure 7:
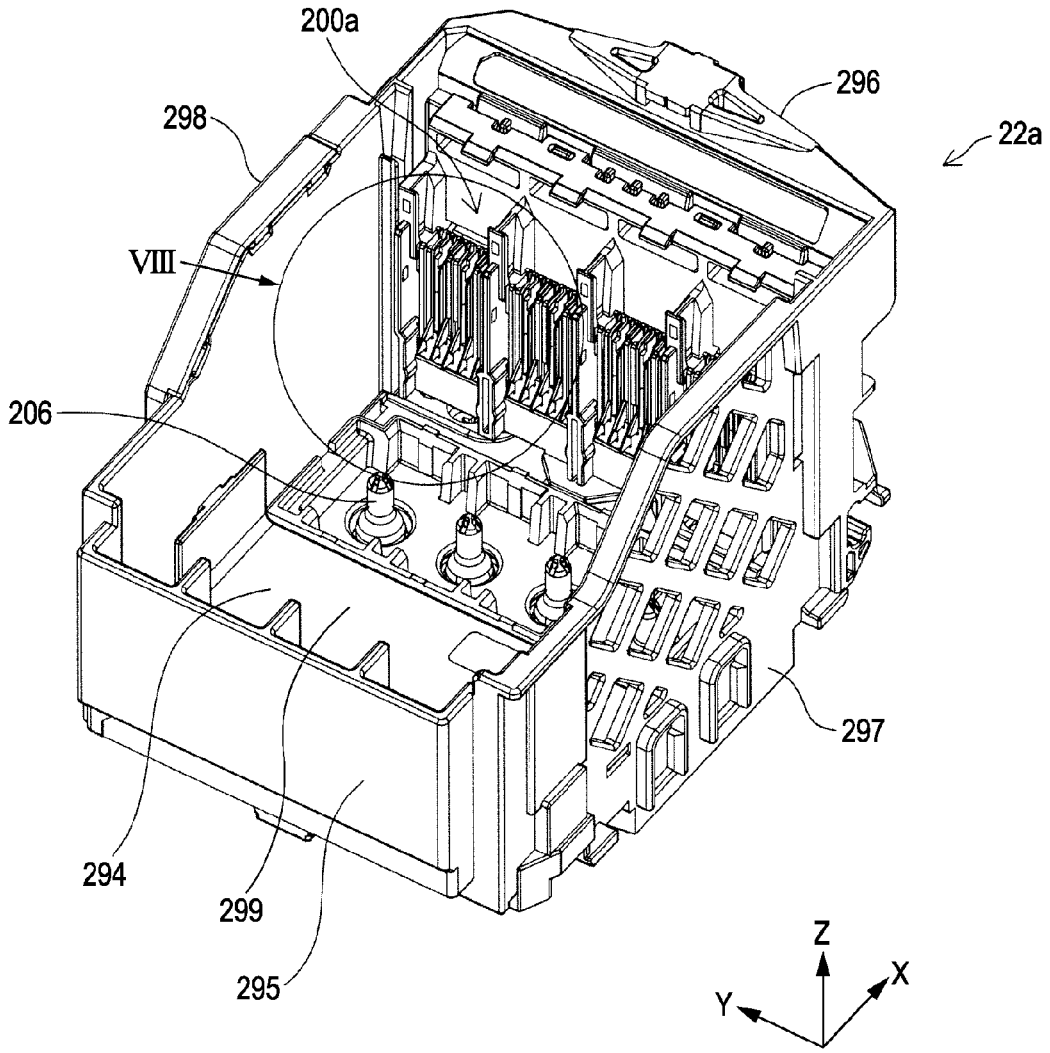
FIG. 7 is a perspective view of a carriage case.
Figure 8:
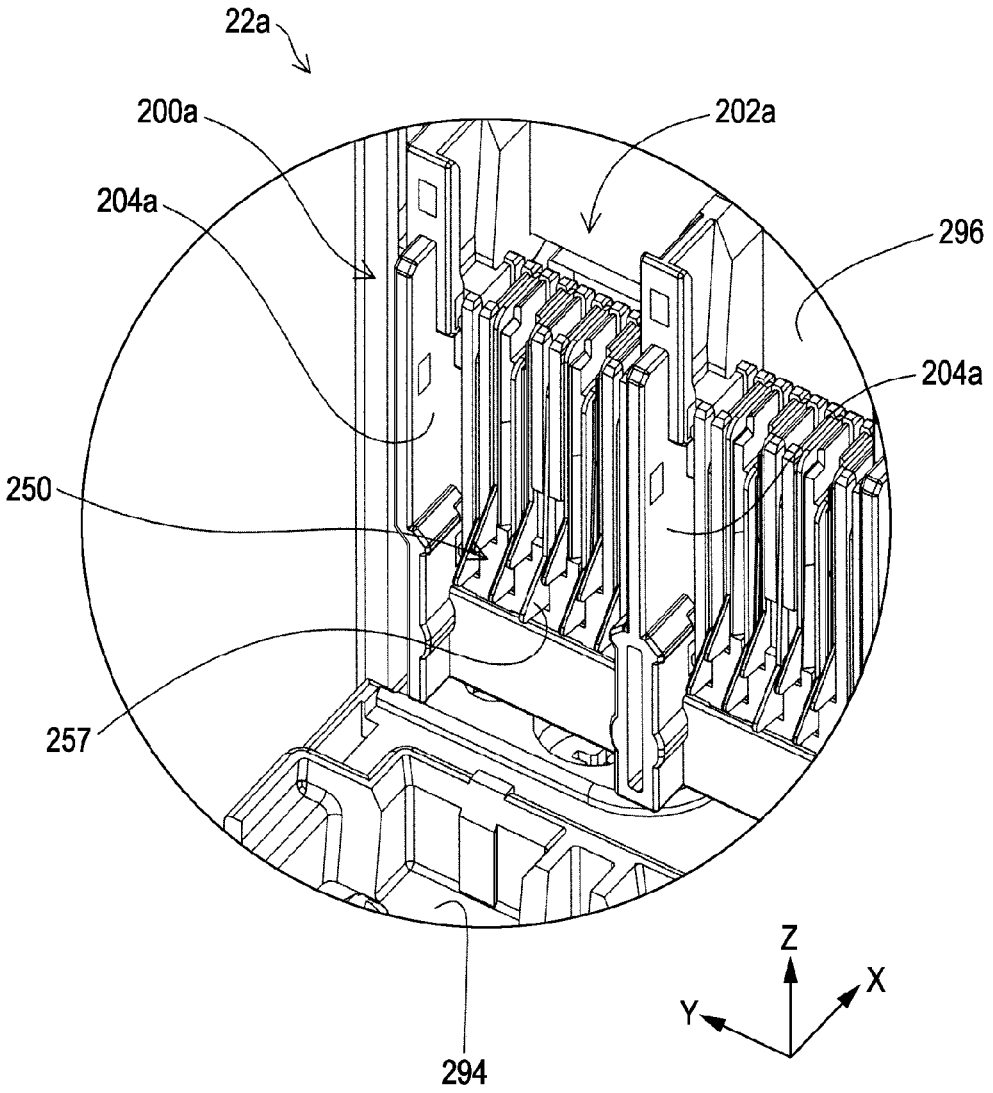
FIG. 8 is an enlarged view of a circled section in FIG. 7.

FIG. 6 is a first view showing a carriage case 22*a* in which a cartridge 100*a* of a second embodiment is detachably mounted. FIG. 7 is a perspective view of the carriage case 22*a*. FIG. 8 is an enlarged view of a circled section in FIG. 7. FIG. 6 shows a state in which one cartridge 100*a* is mounted in the carriage case 22*a* for easy understanding. The carriage case 22*a* will be described with reference to FIGS. 6 to 8. In the carriage case 22*a* of the second embodiment, the same reference numerals will be attached to refer to the same configuration of the carriage case 22 in the first embodiment, and the description thereof will be omitted as necessary.

As shown in FIGS. 6 to 7, the carriage case 22*a* is mounted in the ink jet printer 10 of the first embodiment (simply referred to as the "printer 10"). The ejecting head 24 is provided in a side of the carriage case 22*a* which faces the printing medium 2 as the first embodiment (FIG. 1).

The carriage case 22*a* has a concave shape. The carriage case 22*a* has a case bottom wall 294, a case front wall 296, a case back wall 295, a first case side wall 297, and a second case side wall 298. The concave shape of the carriage case 22*a* is formed by each wall 294 to 298. In other words, the carriage case 22*a* is partitioned a receiving space unit 299 which receives the cartridge 100*a* by the each wall 294 to 298.

The ink acquisition needle (liquid acquisition needle) 206 is protrusively provided on the case bottom wall 294. The through hole 208 is provided on the case bottom wall 294 (FIG. 6). The through hole 208 is provided so as to face the prism provided in the cartridge 100*a* which will be described later. The two through holes 208 are provided in each cartridge 100*a*, and it is possible to set one as a hole to transmit the light to the prism from the light emitting unit 302 provided in the printer 10 and the other as a hole to transmit the light to the light receiving unit 304 from the prism. A predetermined member is provided between the two through holes 208, and the position of the predetermined member overlaps a position in which a ridge line of a triangular prism is vertically projected. When the printer 10 is provided on a horizontal plane surface (a plane surface paralleled with the X-axis direction and the Y-axis direction), the bottom portion of the carriage case 22*a* is configured with the case bottom wall 294.

As shown in FIGS. 6 and 7, the case front wall 296 is vertically provided from the case bottom wall 294. In the case front wall 296, a connector unit 200*a* to which a substrate unit of the cartridge 100*a* described later is electrically connected is provided. As shown in FIG. 8, the connector unit 200*a* has a connector 202*a* and an apparatus side control unit 204*a*. The connector 202*a* is provided in a plurality. Specifically, five connectors 202*a* arranged in the arranged direction (the Y-axis direction) of the cartridge 100*a* and four connectors 202*a* arranged at a position apart from the case bottom wall 294 than the five connectors 202*a* in the arranged direction are provided in the case front wall 296. The connector which is positioned in the lower row of the plurality of connectors 202*a* and in the middle of the five (the third from the left) is also referred to as a first connector 257. The first connector 257 is provided so as to protrude to the case front wall 296 in comparison with other connectors 202*a*.

The apparatus side control unit 204*a* controls the movement of the cartridge 100*a* in the mounted state by touching the cartridge 100*a*, and the substrate unit of the cartridge 100*a* is positioned to the carriage case 22*a*. Specifically, the positive and negative direction sides of the Y axis of one substrate unit are positioned so as to be inserted between the convex portions of two apparatus side control units 204*a*.

As shown in FIGS. 6 and 7, the case back wall 295 is vertically provided from the case bottom wall 294. The case back wall 295 faces the case front wall 296. The first case side wall 297 is vertically provided from the case bottom wall 294. The second case side wall 298 is vertically provided from the case bottom wall 294. The second case side wall 298 faces the first case side wall 297.

B-2. Schematic Configuration of Cartridge

Figure 9:
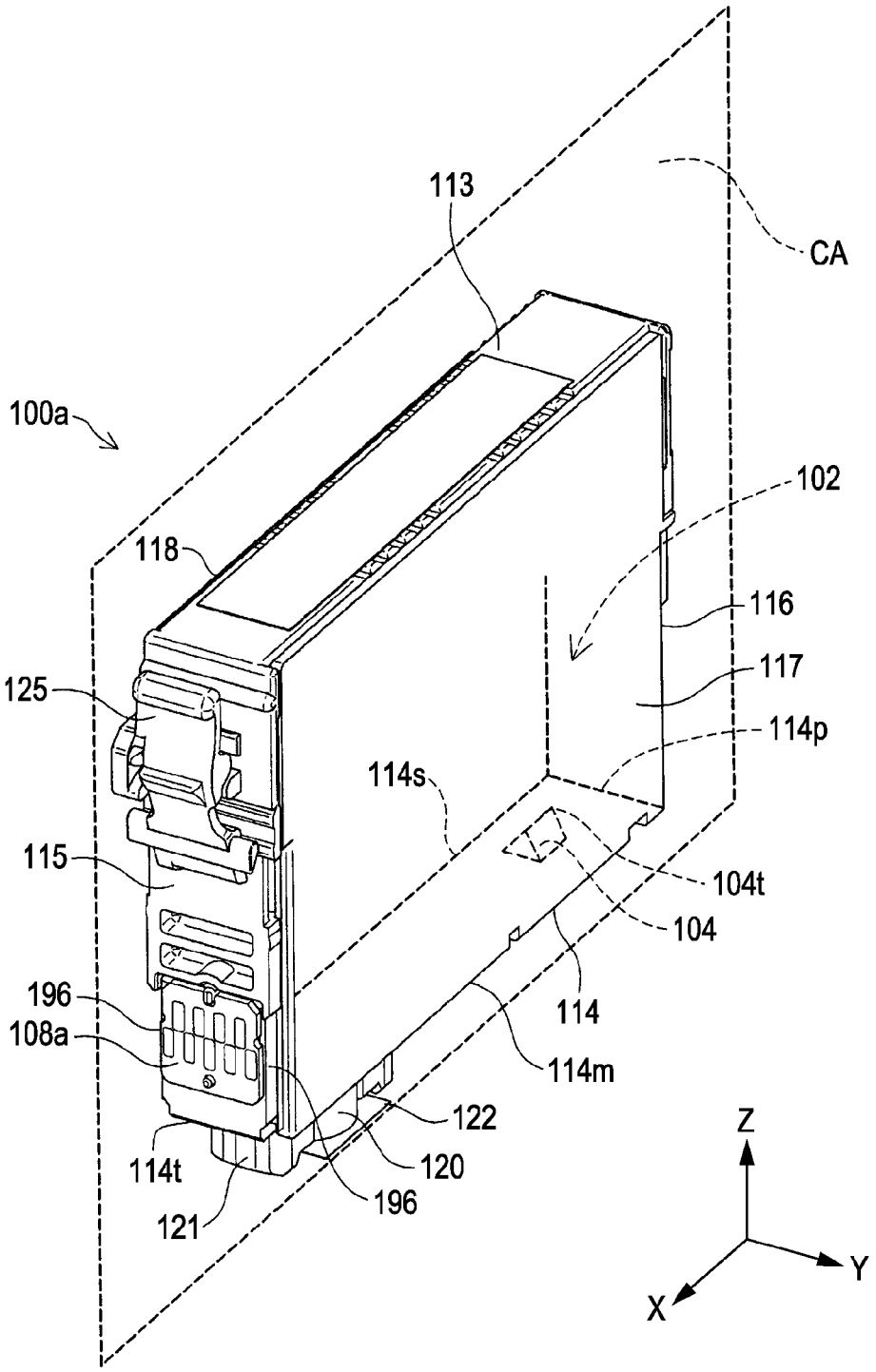
FIG. 9 is a first perspective view of a cartridge of the second embodiment.
Figure 10A:
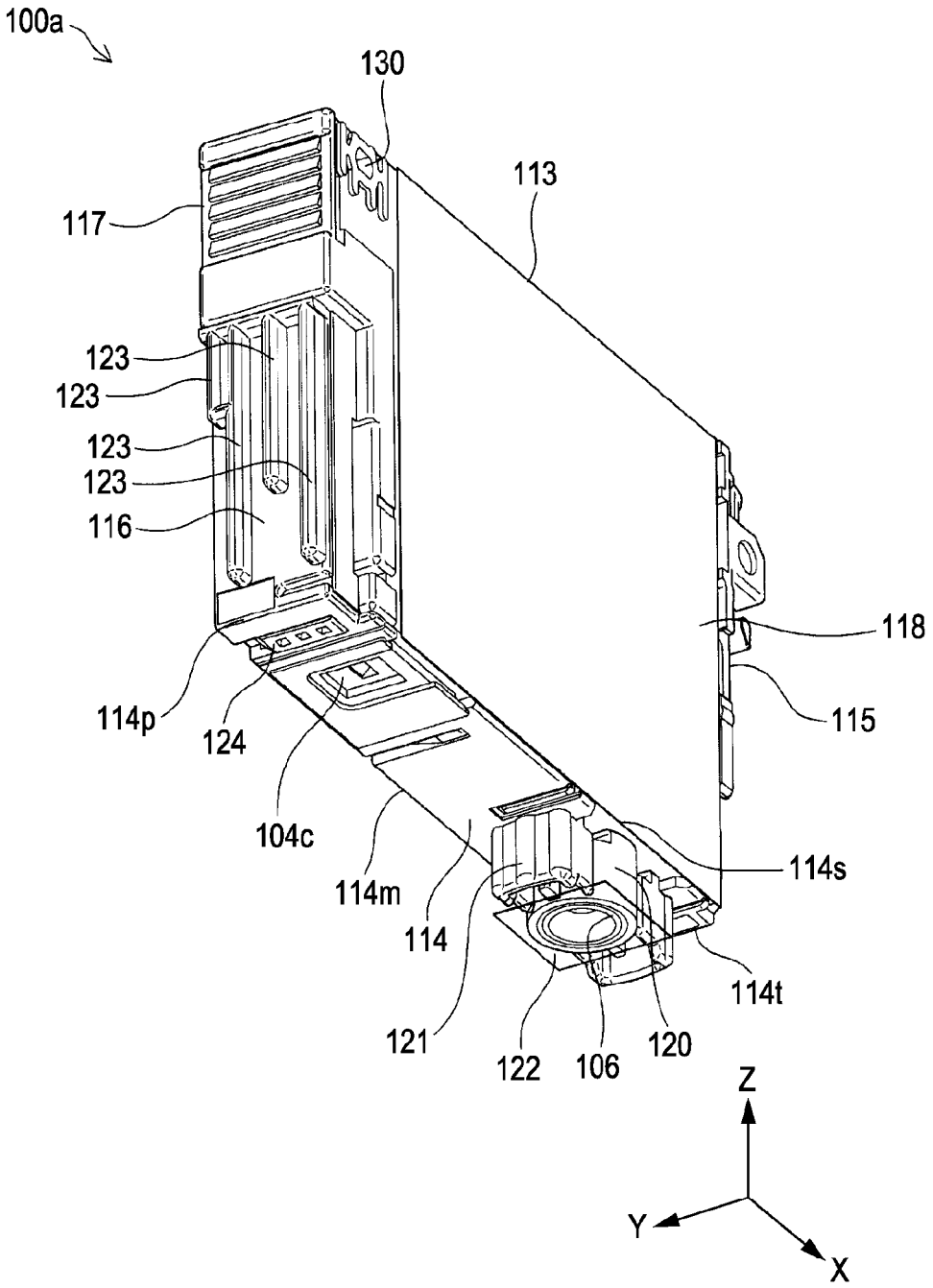
FIG. 10A is a second perspective view of the cartridge.
Figure 10B:
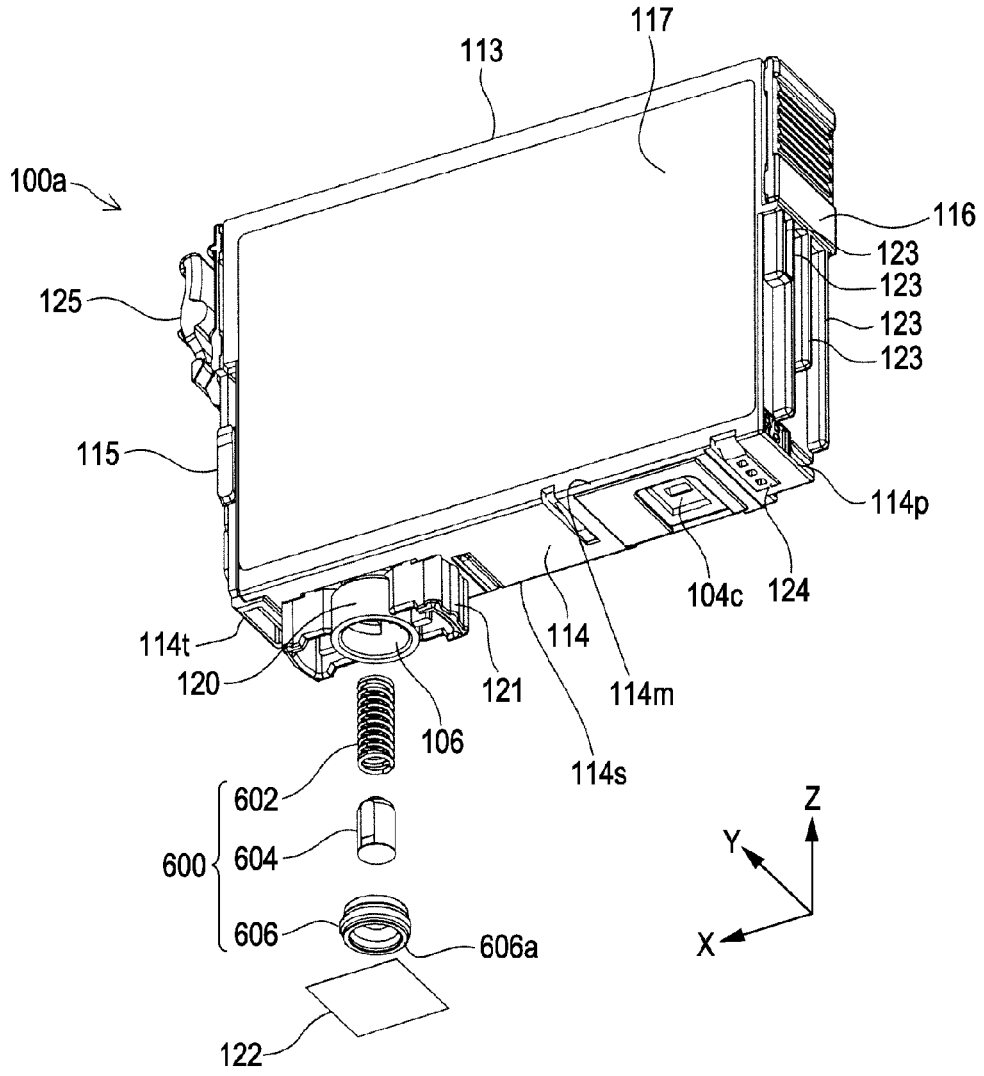
FIG. 10B is a partially exploded perspective view of the cartridge.

FIG. 9 is a first perspective view of the cartridge 100*a* of the second embodiment. FIG. 10A is a second perspective view of the cartridge 100*a*. FIG. 10B is a partially exploded perspective view of the cartridge 100*a*. In the mounted state (the mounted posture) in which the cartridge 100*a* is mounted in the printer 10 arranged on the horizontal plane surface, the Z-axis direction is a vertical direction. In the mounted state, the negative direction of the Z axis is a vertical and lower direction. The horizontal plane surface is a plane surface which is paralleled to the X-axis direction and the Y-axis direction. In the cartridge 100*a* of the second embodiment, the same reference numerals will be attached to refer to the same configuration of the cartridge 100 in the first embodiment, and the description thereof will be omitted as necessary.

As shown in FIGS. 9 and 10A, the outer shape of the cartridge 100*a* is approximately a rectangular shape. The outer surface of the cartridge 100*a* (the shell) is made up of six surfaces. The six surfaces are a bottom surface 114, an upper surface 113, a front surface 115, a back surface 116, a right side surface 117, and a left side surface 118. It can be said that the six surfaces, 113 to 118, are shell members which configures the shell of the cartridge 100*a*. Each surface 113 to 118 is a plane shape. The plane shape includes a case that the entire surface is flat and a case that a part of the surface has unevenness. That is, there may be some unevenness in the part of the surface. Each surface 113 to 118 has a rectangular outer shape as seen from plane view. The bottom surface 114 has a horizontal plane surface at the proper posture (right posture) originally designed in the mounted state.

The front surface 115 extends from one end 114*t* in a longitudinal direction of the bottom surface 114 (the X-axis direction). The back surface 116 extends from other end 114*p* of the bottom surface 114 in the longitudinal direction. The front surface 115 and the back surface 116 face each other. The upper surface 113 faces the bottom surface 114 to intersect the front surface 115 and the back surface 116. The right side surface 117 extends from one end 114*m* of the back surface 114 in a short direction (the Y-axis direction). The left side surface 118 extends from other end 114*s* of the bottom surface 114 in the short direction (the Y-axis direction). The right side surface 117 and the left side surface 118 face each other.

The bottom surface 114 is a concept including a wall which forms the bottom wall of the cartridge 100*a* in the mounted state and can be referred to as the "bottom wall portion (bottom wall) 114". The upper surface 113 is a concept including a wall which forms the upper wall of the cartridge 100*a* in the mounted state and can be referred to as the "upper wall portion (upper wall) 113". The front surface 115 is a concept including a wall which forms the front wall of the cartridge 100*a* in the mounted state and can be referred to as the "front wall portion (front wall) 115". The back surface 116 is a concept including a wall which forms the back wall of the cartridge 100*a* in the mounted state and can be referred to as the "back wall portion (back wall) 116". The right side surface 117 is a concept including a wall which forms the right wall of the cartridge 100*a* in the mounted state and can be referred to as the "right wall portion (right wall) 117". The left side surface 118 is a concept including the left wall of the cartridge 100*a* in the mounted state and can be referred to as the "left wall portion (left wall) 118". "Wall portion" and "wall" are not necessary to be formed by a single wall, and may be formed by a plurality of walls. For example, the bottom wall portion (bottom wall) 114 is a wall which is positioned in the negative direction of the Z axis to the inner space of the cartridge 100*a* in the mounted state.

Here, the front surface 115 is also referred to as the first side surface 115. The back surface 116 is also referred to as the second side surface 116. The right side surface 117 is also referred to as the third side surface 117. The left side surface 118 is also referred to as the fourth side surface 118.

A length (length in the X-axis direction), a width (length in the Y-axis direction), and a height (length in the Z-axis direction) of the cartridge 100*a* are large in order of the length, the width, and the height. The magnitude relationship of the length, the width, and the height of the cartridge 100*a* can be arbitrarily changed, and for example, the height, the length, and the width may be large in order and the height, the length, and the width may be same.

As shown in FIG. 10A, the liquid supply unit 120 extends to the position closer to one end 114*t* than the other end 114*p* of the bottom surface 114. The ink supply port 106 is formed in one end of the liquid supply unit 120. The liquid supply unit 120 is a section to which the ink acquisition needle 206 is inserted in the mounted state. The liquid supply unit 120 has a cylindrical shape and the ink supply port has a circular shape. In the cartridge 100*a* which is not yet mounted in the printer 10, the ink supply port 106 is blocked by a film 51. The film 51 is configured so as to be torn by the ink acquisition needle 206. The film 51 may be peeled off and cartridge 100*a* may be mounted in the printer 10. In the mounted state, a sealing unit 121 to suppress the ink from leaking outside is provided in the vicinity of the liquid supply unit 120. The sealing unit 121 abuts onto the case bottom wall 294.

As shown in FIG. 10B, a supply unit 600 is arranged in the liquid supply unit 120. The supply unit 600 has a seal member 606, a spring seat 604, and a spring 602 in order of being close to the ink supply port 106 of the liquid supply unit 120. When the ink acquisition needle 206 of the printer 10 is inserted into the liquid supply unit 120, the seal member 606 seals between the inner wall of the liquid supply unit 120 and the outer wall of the ink acquisition needle 206 so as not to generate a gap. When the cartridge 100*a* is not mounted in the carriage case 22*a*, the spring seat 604 abuts onto the seal member 606 to block the channel in the liquid supply unit 120. The spring 602 is biased in a direction in which the spring seat 604 abuts onto the seal member 606. When the ink acquisition needle 206 is inserted into the liquid supply unit 120 to push up the spring seat 44, a gap between the spring seat 44 and the seal member 46 is generated and the ink is supplied to the ink acquisition needle 206 from the gap. An end 606*a* of the seal member 606 in the ink supply port 106 side has a circular shape.

As shown in FIG. 10A, the light transmission surface 104*c* is provided at a position closer to other end 114*p* than one end 114*t* of the bottom surface 114 in the longitudinal direction. A protrusion 124 is provided at a position closer to other end 114*p* than one end 114*t* of the bottom surface 114 in the longitudinal direction. The protrusion 124 is provided at the position closer to other end 114*p* than the prism 104 which includes the light transmission surface 104*c* in the bottom surface 114.

As shown in FIG. 9, a substrate unit 108*a* is provided on the first side surface 115. The substrate unit 108*a* stores various kinds of information relating to the cartridge 100*a* (for example, ink colors, and a remaining ink amount) as the first embodiment. A lever 125 is provided as an elastic member at a position closer to the upper surface 113 side than the substrate unit 108*a* in the first side surface 115. The lever 125 is used for mounting and detaching the cartridge 100*a* to the carriage case 22*a*. The lever 125 makes the first side surface 115 biased in a direction toward other end 114*p* from one end 114*t* (the negative direction of the X-axis) in the mounted state. A pair of container side control units 196 positioned in both sides of the bottom surface 114 in the short direction (the Y-axis direction) are provided on the first side surface 115 to the substrate unit 108*a*. That is, the pair of container side control units 196 is provided so as to interpose the substrate unit 108*a* from both sides in the width direction of the cartridge 100*a*. The pair of container side control units 196 has a plane shape.

As shown in FIG. 9, the prism 104 which is a triangular prism is arranged in the ink accommodating chamber 102 as the first embodiment. The prism 104 which includes the light transmission surface 104*c* is arranged at the position closer to other end 114*p* than one end 114*t* of the bottom surface 114 in the longitudinal direction. Here, the prism 104 is arranged so that a ridge line 104*t* forming the apex of the prism 104 extends along the longitudinal direction of the bottom surface 114 (the X-axis direction). Here, a plane surface perpendicular to the bottom surface 114 of plane surfaces including the ridge line 104*t* is set as a virtual surface CA. The virtual surface CA is a plane surface paralleled to the X-axis direction and the Z-axis direction.

As shown in FIG. 10A, a plurality of side protrusions 123 are provided on the second side surface 116. Each side protrusion 123 has a rib shape. As shown in FIG. 10A, an air clear aperture 130 to introduce air therein is formed on the left side surface 118.

B-3. Configuration of Substrate unit 108*a*

Figure 11:
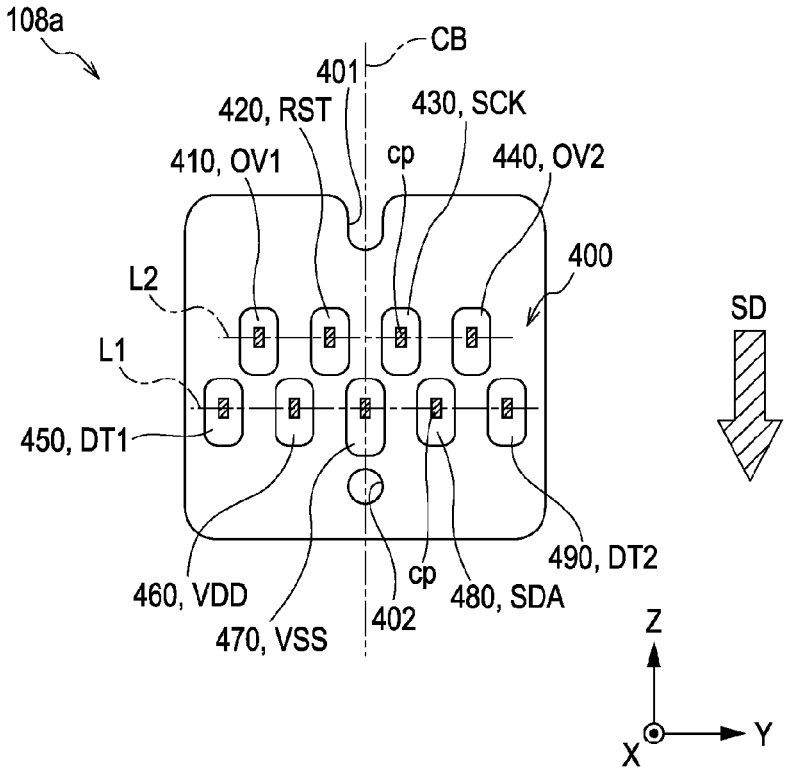
FIG. 11 is a view showing a surface of a substrate unit.
Figure 12:
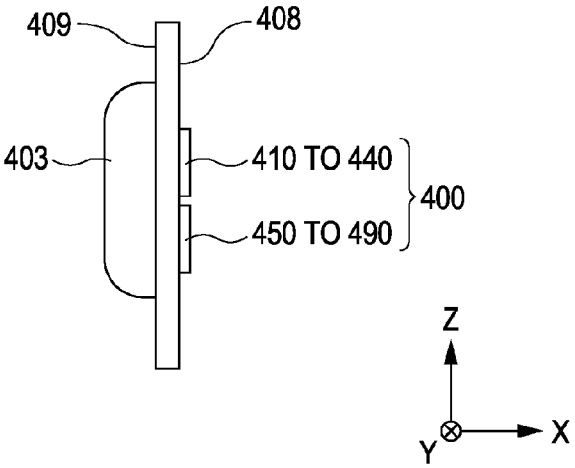
FIG. 12 is a view showing a side surface of the substrate unit.

FIG. 11 is a view showing the surface of the substrate unit 108*a*. FIG. 12 is a view showing the side surface of the substrate unit 108*a*. As shown in FIG. 11, the substrate unit 108*a* has a boss groove 401 and a boss hole 402. The substrate unit 108*a* in the state of being provided in the cartridge 100*a* is attached to the first side surface 115 (FIG. 9) of the cartridge 100*a* using the boss groove 401 and the boss hole 402.

As shown in FIGS. 11 and 12, the substrate unit 108*a* has a container side terminal group 400 which is provided on a surface 408, and a memory 403 which is provided on a rear surface 409. The container side terminal group 400 is formed with nine container side terminals 410 to 490. The memory 403 stores information relating to the ink of the cartridge 100*a* (for example, a remaining ink amount, and ink colors) and the like.

As shown in FIG. 11, each of the nine container side terminals 410 to 490 are formed in an approximately rectangular shape, and arranged so as to form two rows approximately perpendicular to a mounting direction SD (a direction in which the bottom surface 114 and the upper surface 113 face each other). In other words, the terminals of each row are arranged in the short direction of the bottom surface 114 (the Y-axis direction). One of the two rows where five container side terminals 450 to 490 are arranged is referred to as a first terminal row L1, and the other is referred to as a second terminal row L2 where four container side terminals 410 to 440 are arranged at a position apart from the bottom surface 114 than the first terminal row L1. Here, the five container side terminals 450 to 490 provided in the first terminal row L1 correspond to "a plurality of container side terminals" in Solution to Problem. A contact portion cp which comes into contact with the corresponding connector 202*a* (FIG. 8) is present in the center of each container side terminal 410 to 440. It is considerable that the first and second terminal rows L1 and L2 are rows which are formed by the plurality of contact portions cp.

Each container side terminal 410 to 490 can be respectively referred to as following based on functions (uses).

(First Terminal Row L1)

(5) Mounting Detection Terminal 450 (High-voltage Terminal)

(6) Power Terminal 460 (Low-voltage Terminal)

(7) Earth Terminal 470

(8) Data Terminal 480 (Low-voltage Terminal)

(9) Mounting Detection Terminal 490 (High-voltage Terminal)

(Second Terminal Row L2)

(1) Overvoltage Detection Terminal 410

(2) Reset Terminal 420 (Low-voltage Terminal)

(3) Clock Terminal 430 (Low-voltage Terminal)

(4) Overvoltage Detection Terminal 440

A pair of overvoltage detection terminals 410 and 440 are terminals to detect an excessively high voltage value (referred to as "overvoltage"). A pair of mounting detection terminals 450 and 490 are used to detect whether the mounted state of the cartridge is good or bad. The overvoltage detection terminals 410 and 440 may be used to detect the mounted state as well as the overvoltage detection. In the embodiment, since a voltage (rating 42 V or 36 V) higher than a power supply voltage for the memory 403 (rating 3.3 V) is applied to the mounting detection terminals 450 and 490, the mounting detection terminals are also referred to as "high-voltage terminals" or "terminals for applying high voltage". Other five terminals 420, 430, 460, 470, and 480 are terminals for the memory 403. Since the voltage (rating 3.3 V) lower than that of the high-voltage terminals 450 and 490 is applied to four terminals 420, 430, 460, and 480 other than the earth terminal 470 of the five terminals, the four terminals are referred to as "low-voltage terminals" or "terminals for applying low voltage".

As shown in FIG. 11, the earth terminal 470 as a first container side terminal is provided at a position to pass a center line CB on the surface 408 of the substrate unit 108*a* in the short direction of the bottom surface 114 (the Y-axis direction). The contact portion cp of the earth terminal 470 also passes the center line CB. The center line CB is also a center line with a width of the cartridge 100*a* in the Y-axis direction.

When the cartridge 100*a* is mounted in the carriage case 22*a*, an earth terminal 437 is formed to come into contact with the first connector 257 (FIG. 8) before the earth terminal 437 comes into contact with the connector 202*a* by other container side terminals 431 to 436, 438, and 439. Due to this, a biased force firstly applied to the substrate unit 108*a* from the connector 202*a* is generated in the center of the width of the cartridge 100*a* in the Y-axis direction. Accordingly, an action that the biased force applied to the substrate unit 108*a* makes the cartridge 100*a* inclined in the Y-axis direction is controlled and the cartridge 100*a* can be mounted at a designed mounted position. Since the earth terminal 437 comes into contact with the first connector 257 before the earth terminal 437 comes into contact with other container side terminals 431 to 436, 438, and 439, even when an unintended high voltage is applied to the cartridge 100*a*, defects due to the high voltage can be reduced by the function of the earth terminal 437.

In the embodiment, the earth terminal 437 is formed to be longer in a direction along the Z axis than other container side terminals 431 to 436, 438, and 439. Due to this, the contact of the earth terminal 437 and the first connector 257 can be more reliably performed. In other embodiment, all of the container side terminals 431 to 439 may be formed to have the same size in the substrate unit 108*a*.

B-4. Positioning of Prism 104

It is preferable for the positional relationship of the prism 104 and the cartridge 100*a* to satisfy at least one of three positional relationships below. Due to this, the positional deviation of the prism 104 to the printer 10 can be suppressed. That is, the positioning of the prism 104 to the printer 10 can be accurately performed.

Figure 13:
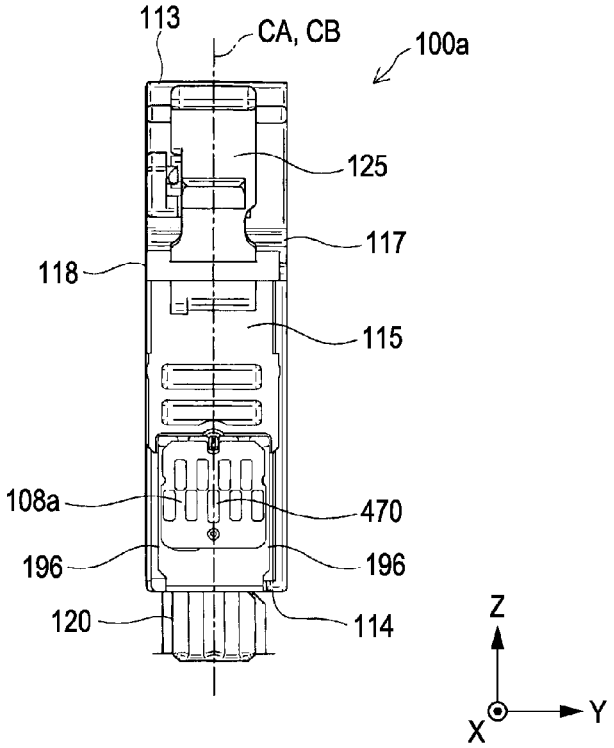
FIG. 13 is a front view of the cartridge.

First Positional Relationship:

FIG. 13 is a front view of the cartridge 100*a*. As shown in FIG. 13, there may be a positional relationship that the virtual surface CA passes the earth terminal 470 (a first positional relationship). That is, the prism 104 is provided in the ink accommodating chamber 102 so as to satisfy the first positional relationship. In the embodiment, the center line CB is in a relationship of overlapping the virtual surface CA. Here, "overlapping" includes not only completely overlapping but also practically overlapping. In detail, when the positional deviation in a case of completely overlapping is smaller than a distance which connects the contact portions cp of the adjacent terminals in the Y-axis direction, it is possible to say substantially overlapping (hereinafter, the same).

Figure 14:
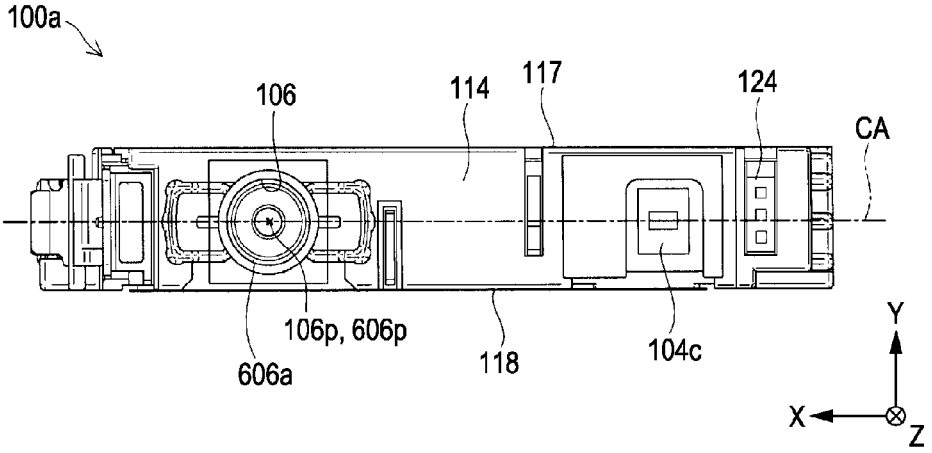
FIG. 14 is a bottom view of the cartridge.

Second Positional Relationship:

FIG. 14 is a bottom view of the cartridge 100*a*. As shown in FIG. 14, there may be a positional relationship that the virtual surface CA passes a center 106*p* of the ink supply port 106 (a second positional relationship). That is, the prism 104 is provided in the ink accommodating chamber 102 so as to satisfy the second positional relationship.

Third Positional Relationship:

As shown in FIG. 14, there may be a positional relationship that the virtual surface CA passes a center 606*p* of the end 606*a* in the seal member 606 (a third positional relationship). That is, the prism 104 is provided in the ink accommodating chamber 102 so as to satisfy the third positional relationship.

The first to third positional relationships may satisfy a plurality of positional relationships at the same time as long as in the range in which the positional relationship is not conflicting. For example, when the plane surface which passes the earth terminal 470 and the surface which passes the center 106*p* of the plane surfaces paralleled with the X-axis and the Z-axis directions match, the prism 104 can be arranged so as to satisfy the first and second positional relationships at the same time. In the embodiment, the first to third positional relationships are satisfied at the same time.

B-5. Internal Configuration of Cartridge 100*a*

Figure 15:
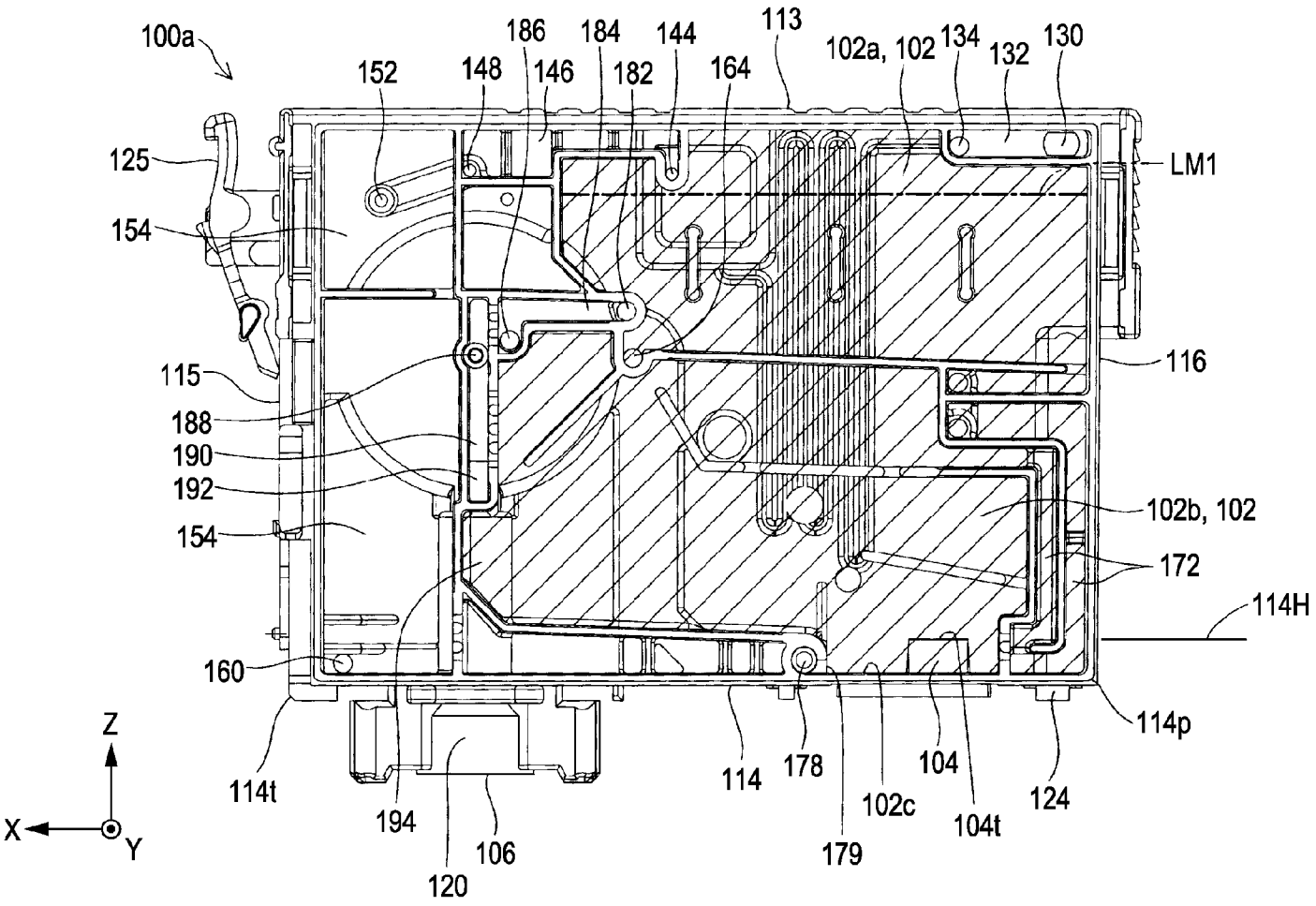
FIG. 15 is a first view to describe an internal configuration of the cartridge.
Figure 16:
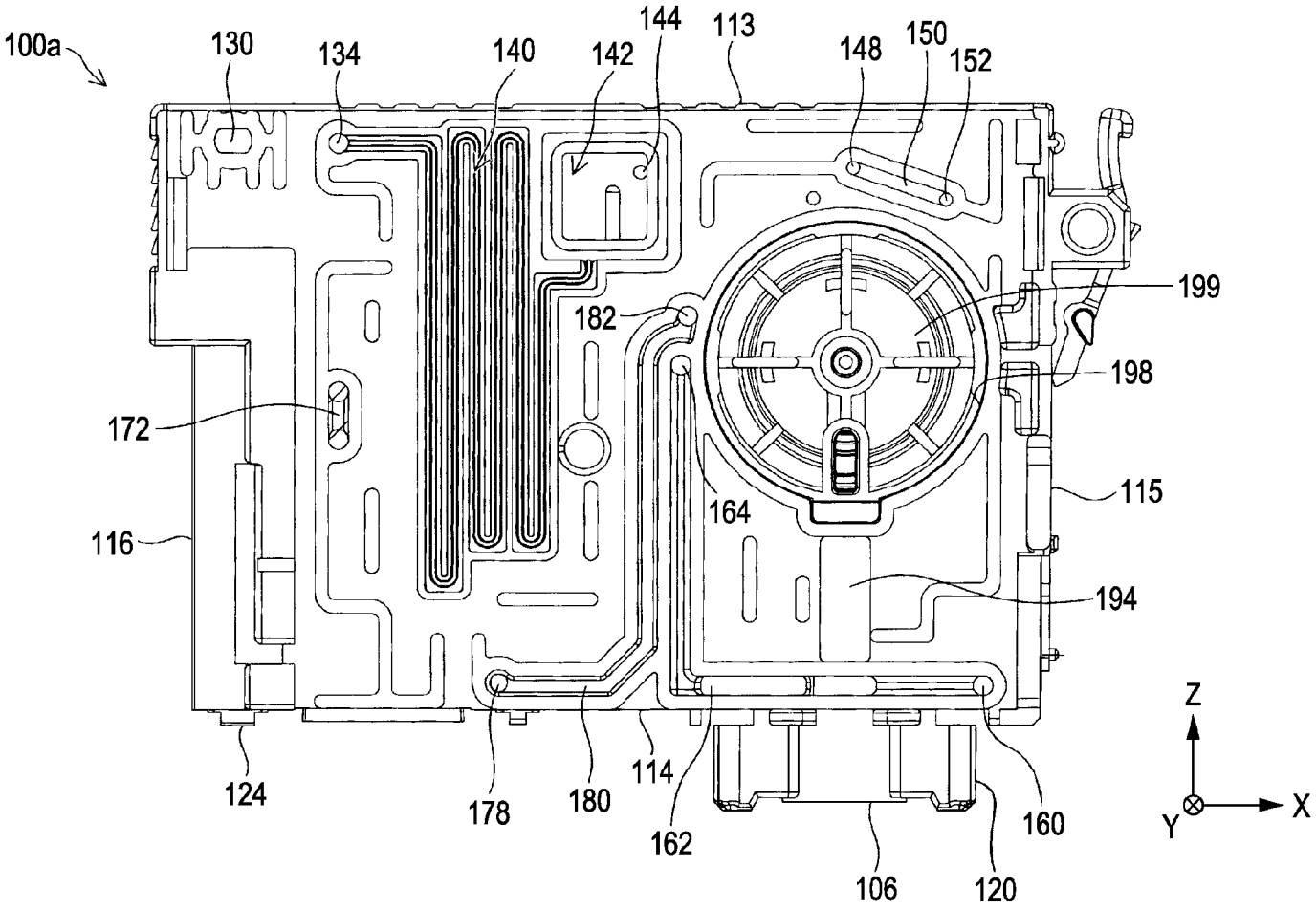
FIG. 16 is a second view to describe the internal configuration of the cartridge.

FIG. 15 is a first view to an internal configuration of the cartridge 100*a*. FIG. 16 is a second view to describe the internal configuration of the cartridge 100*a*. A part of the internal channel from the air clear aperture 130 to the ink supply port 106 is formed by attaching a film to the container main body of the cartridge 100*a*.

As shown in FIGS. 15 and 16, the ink accommodating chamber 102 has a first accommodating chamber 102*a*, a second accommodating chamber 102*b*, a connection channel 172 which communicates with the first accommodating chamber 102*a* and the second accommodating chamber 102*b* (FIGS. 15 and 16). For easy understanding, single hatching is attached to the ink accommodating chamber 102. As shown in FIG. 15, the ink is filled in a state in which the cartridge 100*a* is not used so that the liquid level reaches the first accommodating chamber 102*a* indicated by a dotted line LM 1. When the ink is consumed by the printer 10, the liquid level is lowered to expose the prism 104 from the ink.

As shown in FIG. 15, the prism 104 is arranged on a lowest plane surface 102*c* of the second accommodating chamber 102*b* in the mounted state. Here, the plane surface 102*c* is also referred to as the detection member arranged surface 102*c*. The plane surface is not necessarily a complete plane surface, and there may be an approximately plane surface. For example, the plane surface may include some unevenness.

The ink in the ink accommodating chamber 102 flows to the printer 10 through the liquid conducting channel. A communication port 179 which is one end of the liquid conducting channel is connected to the second accommodating chamber 102*b* and the other end thereof is the ink supply port 106. When the ink is consumed by the printer 10, air is introduced into the ink accommodating chamber 102 through an air introduction channel. One end of the air introduction channel is the air clear aperture 130 (FIG. 16), and the other end thereof is an air communication port 164 (FIG. 15) which is connected to the first accommodating chamber 102*a*.

As shown in FIGS. 15 and 16, the liquid conducting channel has a following configuration in order from the upstream side to the downstream side in a fluid flowing direction from the communication port 179 to the ink supply port 106. In other words, the liquid conducting channel includes a communication port 179, a penetration channel 178 connected to the communication port 179, a first liquid channel 180 connected to the penetration channel 178, a connection hole 182 connected to the first liquid channel 180, a second liquid channel 184 connected to the connection hole 182, a connection hole 186 connected to the second liquid channel 184, a valve chest 198 connected to the connection hole 186, a valve hole 188 which is a downstream end of the valve chest 198, a third liquid channel 190 connected to the valve hole 188, a connection hole 192 connected to the third liquid channel 190, and a supply channel 194 connected to the connection hole 192. Here, the ink supply unit 120 is formed in one end side of the supply channel 194 to protrude from the bottom surface 114.

As shown in FIG. 16, a valve unit 199 is arranged in the valve chest 198 to open and close the valve hole 188. The valve unit 199 makes the valve hole 188 open and close based on pressure differences between the upstream side and the downstream side which interpose the valve hole 188.

As shown in FIG. 15, the communication port 179 is provided at a position closer to one end 114*t* than the prism 104 in the longitudinal direction of the bottom surface 114 (the X-axis direction). The communication port 179 is provided at a position lower than the highest position 114H of the prism 104 in the mounted state where the cartridge 100*a* is mounted in the printer 10, when the cartridge 100*a* is in the right posture. Specifically, the communication port 179 is provided to come into contact with the detection member arranged surface 102*c*. The printer 10 is set to be provided on the horizontal plane surface.

As shown in FIGS. 15 and 16, the air introduction channel has a following configuration in order from the upstream side to downstream side in the fluid flowing direction from the air clear aperture 130 to the air communication port 164. That is, the air introduction channel includes the air clear aperture 130, a first air channel 132 connected to the air clear aperture 130, a connection hole 134 connected to the first air channel 132, a serpentine channel 140 connected to the connection hole 134, a gas-liquid separating chamber 142 connected to the serpentine channel 140, a connection hole 144 connected to the gas-liquid separating chamber 142, a second air channel 146 connected to the connection hole 144, a connection hole 148 connected to the second air channel 146, a third air channel 150 connected to the connection hole 148, a connection hole 152 connected to the third air channel 150, an air chamber 154 connected to the connection hole 152, a connection hole 160 connected to the air chamber 154, a fourth air channel 162 connected to the connection hole 160, and an air communication port 164 connected to the fourth air channel 162. A gas-liquid separation film (not shown) is provided in the gas-liquid separating chamber 142 shown in FIG. 16 to be partitioned into the upstream side and the downstream side. The gas-liquid separation film has properties that gas penetrates the gas-liquid separation film but liquid does not penetrate the gas-liquid separation film.

Figure 17:
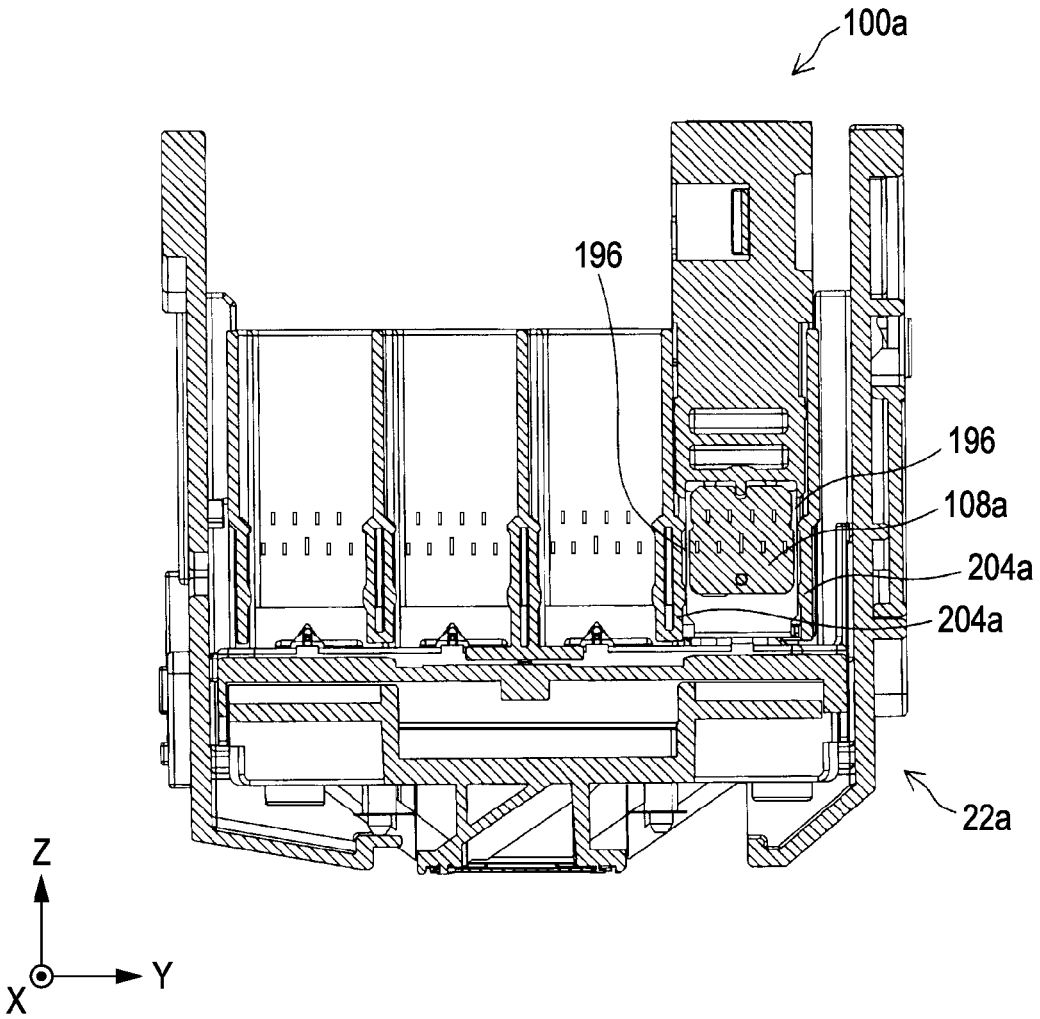
FIG. 17 is a cross-sectional view taken along XVII-XVII of FIG. 6.

FIG. 17 is a cross-sectional view of FIG. 6 cut along XVII-XVII. As shown in FIG. 17, the pair of the container side control units 196 in the cartridge 100*a* abuts onto the apparatus side control unit 204*a* of the carriage case 22*a* in the mounted state. Due to this, positioning the substrate unit 108*a* to the printer 10 is performed.

B-6. Effect

Figure 18:
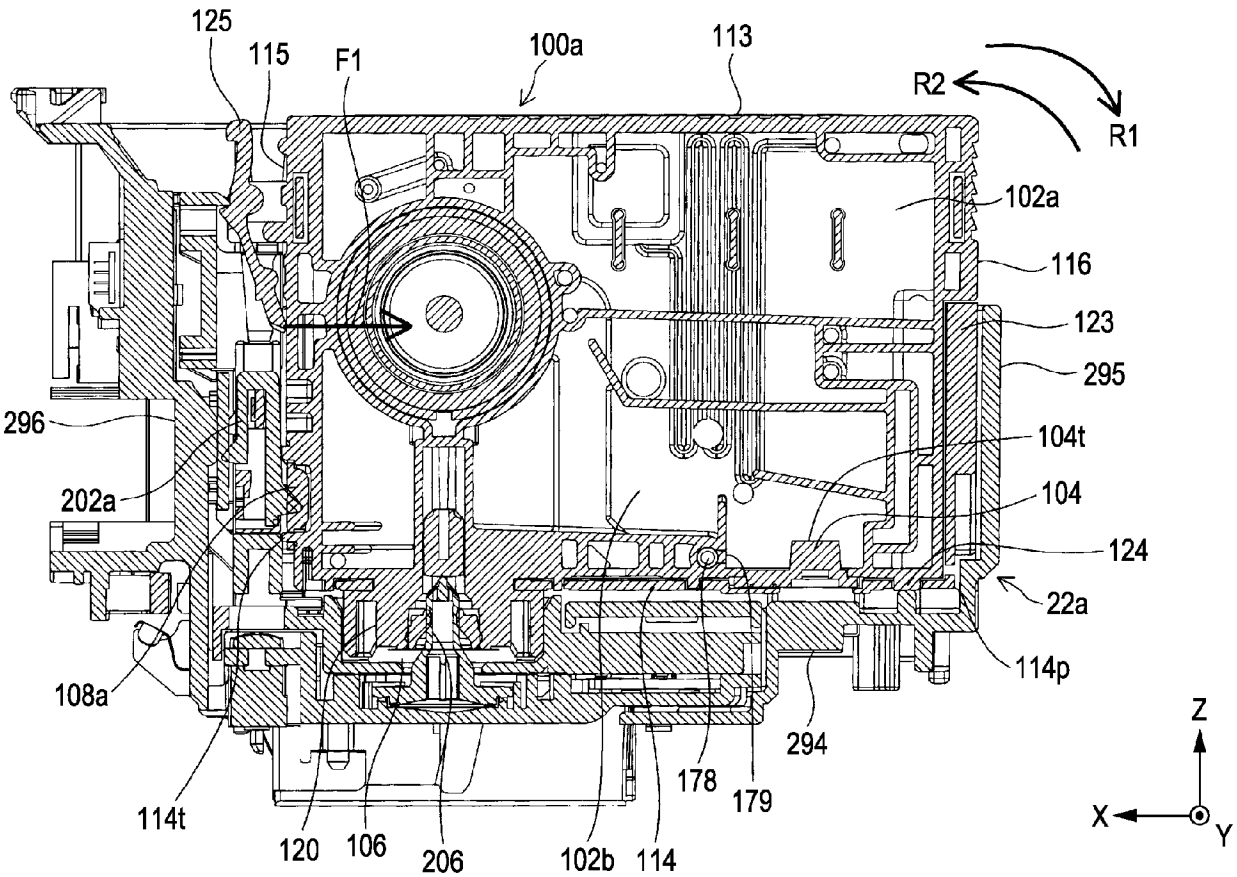
FIG. 18 is a cross-sectional view taken along XVIII-XVIII of FIG. 6.

FIG. 18 is a cross-sectional view of FIG. 6 cut along XVIII-XVIII. FIG. 18 is a view when the cartridge 100*a* is in the proper posture (right posture) in which the cartridge 100*a* is originally designed in the mounted state. In FIG. 18, for easy understanding, the communication port 179 is positioned on the same cross-sectional view.

As shown in FIG. 18, when the cartridge 100*a* is in the right posture, the protrusion 124 abuts onto the case bottom wall 294 of the carriage case 22*a*. For this reason, even when the cartridge 100*a* in the mounted state is inclined to an arrow R1 direction by external force such as vibration, since the protrusion 124 abuts onto the case bottom wall 294, the movement of the cartridge 100*a* in the arrow R1 direction can be controlled. Here, the arrow R1 direction is a direction that the cartridge 100*a* rotates so that one end 114*t* of the bottom surface 114 is positioned in an upper side, and other end 114*p* of the bottom surface 114 is positioned in a lower side in comparison with the time of the right posture. In other words, the movement of the cartridge 100*a* to the arrow R1 direction in the mounted state can be controlled by the protrusion 124. Due to this, it is possible to suppress a state where the ink is eccentrically present in the side where the prism 104 is positioned in the ink accommodating chamber 102, and the ink is not present in a side where the communication port 179 is positioned (the first state). Accordingly, it is possible to avoid the situation that the ink is not supplied to the printer 10 from the cartridge 100*a* regardless of the determination of the remaining ink amount state as "ink remaining" by the printer 10.

In particular, the protrusion 124 is provided at a position closer to other end 114*p* of the bottom surface 114 than the prism 104. Even when the cartridge 100*a* tries to move so that one end 114*t* of the bottom surface 114 is positioned in the upper side, and other end 114*p* is positioned in the lower side in comparison with the time of the right posture, the protrusion 124 can more stably control the movement of the cartridge 100*a* by abutting onto the case bottom wall 294. That is, even when a strong external force to rotate the cartridge 100*a* is applied to the cartridge 100*a* in the arrow R1 direction by a strong shock and the like, the protrusion 124 can control the movement of the cartridge 100*a* by abutting onto the case bottom wall 294. For this reason, it is possible to stably suppress that the cartridge 100*a* is inclined from the right posture to be the first state.

The cartridge 100*a* has a side protrusion 123 on the second side surface 116. When the cartridge 100*a* moves to the arrow R1 direction, the side protrusion 123 abuts onto the case back wall 295 and controls the movement of the cartridge 100*a* in the arrow R1 direction. Accordingly, it is possible to further suppress that the cartridge 100*a* is inclined from the right posture to be the first state.

The ink supply unit 120 extends from the position closer to one end 114*t* than other end 114*p* in the bottom surface 114. Due to this, when the cartridge 100*a* is inclined in an arrow R2 direction, since the ink supply unit 120 abuts onto the carriage case 22*a* (in detail, the case bottom wall 294), the movement of the cartridge 100*a* in the arrow R1 direction can be controlled. For this reason, the incline of the cartridge 100*a* from the right posture can be further suppressed. Here, the arrow R2 direction is a direction where the cartridge 100*a* rotates so that other end 114*p* of the bottom surface 114 is positioned in the upper side and one end 114*t* of the bottom surface 114 is positioned in the lower side in comparison with the time of the right posture.

The cartridge 100*a* has the lever 125 on the first side surface 115. The lever 125 makes the first side surface 115 biased to other end 114*p* from one end 114*t* in the mounted state. In FIG. 18, in the mounted state, the lever 125 makes the first side surface 115 biased to the negative direction of the X axis with force F1. Due to this, it is possible to push the cartridge 100*a* to the case back wall 295. Accordingly, the possibility that the cartridge 100*a* can relatively move to the printer 10 by the external force can be reduced. That is, it is possible to suppress the positional deviation of the cartridge 100*a* to the printer 10. For example, even when the cartridge 100*a* moves in a direction where the lever 125 is compressed as the arrow R2 direction, the cartridge 100*a* can be returned to the right posture due to restoring force of the lever 125.

As shown in FIG. 13, it is possible to suppress the positional deviation of the prism 104 to the printer 10 by providing the prism 104 so as to satisfy the positional relationship that the virtual surface CA passes the earth terminal 470. In other words, positioning the prism 104 to the printer 10 can be precisely performed. That is, positioning the substrate unit 108*a* to the printer 10 can be performed by the pair of container side control units 196 which is positioned in both sides in the short direction to the substrate unit 108 (FIG. 17). Accordingly, by determining the position of the prism 104 in the cartridge 100*a* on the basis of the substrate unit 108*a* which is positioned, the positional deviation of the prism 104 to the printer 10 can be suppressed. In particular, the earth terminal 470 which passes the center line CB on the surface 408 of the substrate unit 108*a* is more difficult to generate the positional deviation to the printer 10 than other terminals 410 to 440, 450, 460, 480, and 490. Therefore, it is possible to more suppress the positional deviation of the prism 104 to the printer 10 by positioning the prism 104 on the basis of the earth terminal 470.

As shown in FIG. 14, it is possible to suppress the positional deviation of the prism 104 to the printer 10 by providing the prism 104 so as to satisfy the positional relationship that the virtual surface CA passes the center 106*p* of the ink supply port 106. In other words, positioning the prism 104 to the printer 10 can be precisely performed. That is, the ink acquisition needle 206 is inserted into the ink supply unit 120 including the ink supply port 106. When the cartridge 100*a* is mounted in the carriage case 22*a*, the positioning of the cartridge 100*a* to the printer 10 is firstly performed by the ink supply port 106. Accordingly, it is possible to suppress the positional deviation of the prism 104 to the printer 10 by determining the position of the prism 104 in the cartridge 100*a* on the basis of the ink supply port 106 which is positioned. In particular, the center 106*p* of the ink supply port 106 is difficult to generate the positional deviation to the printer 10 in the ink supply port 106. Therefore, by determining the position of the prism 104 in the cartridge 100*a* on the basis of the center 106*p* of the ink supply port 106, the positional deviation of the prism 104 to the printer 10 can be more suppressed.

As shown in FIG. 14, it is possible to suppress the positional deviation of the prism 104 to the printer 10 by providing the prism 104 so as to satisfy the positional relationship that the virtual surface CA passes the center 606*p* of the end 606*a* in the seal member 606. In other words, positioning the prism 104 to the printer 10 can be precisely performed. Since the seal member 606 is provided in the ink supply unit 120, it can be said that the positioning of the seal member 606 to the printer 10 is also performed. Therefore, by determining the position of the prism 104 in the cartridge 100*a* on the basis of the seal member 606 as the positioning of the prism 104 on the basis of the ink supply port 106, the positional deviation of the prism 104 to the printer 10 can be suppressed.

C. Modification Examples

In the above-described embodiments, the fact that the light transmission surface 104*c* of the prism 104 configures a part of the bottom surface in the ink cartridge 100 has been described. Herein, when the prism 104 is provided in the following manner, it is possible to further suppress foreign substances from becoming attached to the light transmission surface 104*c*.

Figure 19A:
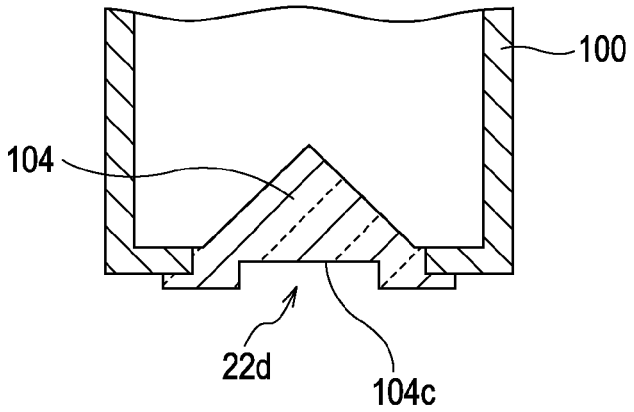
FIG. 19A is an illustrative view showing an installation aspect of a prism in an ink cartridge of a modification example.
Figure 19B:
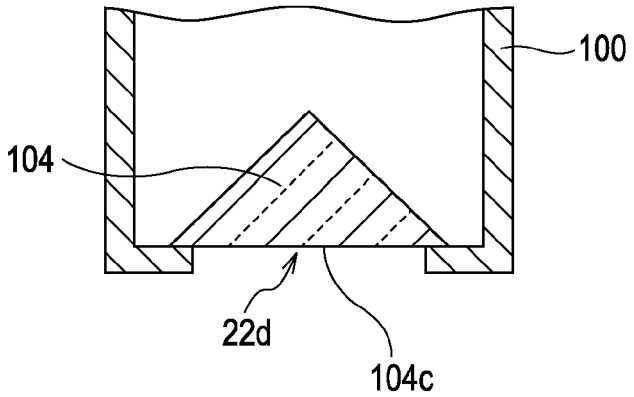
FIG. 19B is an illustrative view showing an installation aspect of a prism in an ink cartridge of a modification example.
Figure 19C:
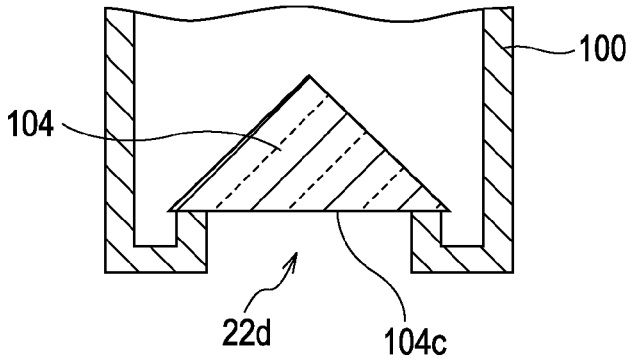
FIG. 19C is an illustrative view showing an installation aspect of a prism in an ink cartridge of a modification example.

FIGS. 19A to 19C are illustrative views showing installation aspects of a prism 104 in an ink cartridge 100 of modification examples. In the ink cartridge 100 shown in FIG. 19A, a concave portion 22*d* is provided on the bottom surface of the prism 104, and the light transmission surface 104*c* is provided in the back of the concave portion 22*d*. In the ink cartridge 100 shown in FIG. 19B, the prism 104 is built in the ink cartridge 100, the concave portion 22*d* which is made up of the bottom surface of the ink cartridge 100 and the bottom surface of the prism 104 is provided, and the light transmission surface 104*c* is provided in the back of the concave portion 22*d*. Moreover, the ink cartridge 100 shown in FIG. 19C has a structure where the bottom surface of the ink cartridge 100 enters into the ink cartridge 100, and the light transmission surface 104*c* is provided in the back of the concave portion 22*d* which is made up of the bottom surface of the ink cartridge 100 and the bottom surface of the prism 104.

From the point that foreign substances are suppressed from becoming attached to the light transmission surface 104*c*, it is preferable for the light transmission surface 104*c* to be apart from the bottom surface of the ink cartridge 100 as much as possible. In the above-described ink cartridge 100 of the modification examples, since the light transmission surface 104*c* can be set to a position entered inside from the bottom surface of the ink cartridge 100, it is possible to suppress foreign substances such as ink and chips from becoming attached to the light transmission surface 104*c*. Since the light transmission surface 104*c* is provided in the back of the concave portion 22*d* with a narrow entrance, contact of the light transmission surface 104*c* with fingers of the user can be suppressed at the time of mounting and detaching the ink cartridge 100. As a result, it is possible to suppress fingerprints from becoming attached to light transmission surface 104*c* to have a negative influence on detecting the remaining ink amount.

Various kinds of embodiments are described above, but the invention is not limited to the embodiments, and can be realized in various aspects in a range of not departing from the scope thereof. For example, the positional relationship of the ink supply port, the substrate unit, and the light transmission surface in the ink cartridge of the above-described embodiments and modification examples may be applied to an ink cartridge which has an ink supply port and a substrate unit and detects a remaining ink amount by applying voltage to a liquid detecting sensor and the like in a liquid accommodation unit from outside. At this time, when a position of the light transmission surface is changed to a position of a contact portion to apply voltage from outside, foreign substances can be suppressed from becoming attached to the contact portion and harmful effects by attaching the foreign substances can be suppressed.

Furthermore, the invention is not limited to an on-carriage type ink jet printer in which an ink cartridge is mounted in a carriage case integrally configured with an ejecting head, and can be applied to an off-carriage type ink jet printer in which a holder which accommodates an ink cartridge and an ejecting head are separately provided.

REFERENCE SIGNS LIST

2 Printing medium
10 Printer
100*a* Cartridge
20 Carriage
22, 22*a* Carriage case
22*d* Concave portion
24 Ejecting head
30 Drive mechanism
32 Timing belt
34 Driving motor
44 Spring seat
46 Seal member
51 Film
60 Control unit
70 Contact portion mechanism
100,100*a* Ink cartridge
102 Ink accommodating chamber
102*a* First accommodating chamber
102*b* Second accommodating chamber
102*c* Plane surface (detection member arranged surface)
104 Prism
104*a* First reflecting surface
104*b* Second reflecting surface
104*c* Light transmission surface
104*t* Ridge line
106 Ink supply port
106*p* Center
108, 108*a* Substrate unit
113 Upper surface
114 Bottom surface
114*m* One end
114*p* Other end
114*s* Other end
114*t* One end
115 Front surface (First side surface)
116 Back surface (Second side surface)
117 Right side surface (Third side surface)
118 Left side surface (Fourth side surface)
120 Ink supply unit
121 Sealing unit
123 Side protrusion
124 Protrusion
125 Lever
130 Air clear aperture
132 First air channel
134 Connection hole
140 Serpentine channel
142 Gas-liquid separating chamber
144 Connection hole
146 Second air channel
148 Connection hole
150 Third air channel
152 Connection hole
154 Air chamber
160 Connection hole
162 Fourth air channel
164 Air communication port
172 Connection channel
178 Penetration channel
179 Communication port
180 First liquid channel
182 Connection hole
184 Second liquid channel
186 Connection hole
188 Valve hole
190 Third liquid channel
192 Connection hole
194 Supply channel
196 Container side control unit
198 Valve chest
199 Valve unit
200, 200*a* Connector unit
202, 202*a* Connector

204 Holder
204*a* Apparatus side control unit
206 Ink acquisition needle
208 Through hole
257 First connector
294 Case bottom wall
295 Case back wall
296 Case front wall
297 First case side wall
298 Second case side wall
299 Receiving space unit
300 Detection unit
302 Light emitting unit
304 Light receiving unit
400 Container side terminal group
401 Boss groove
402 Boss hole
403 Memory
408 Surface
409 Rear surface
410 Overvoltage detection terminal
420 Reset terminal
430 Clock terminal
431 Container side terminal
437 Earth terminal
440 Overvoltage detection terminal
450 Mounting detection terminal
460 Power terminal
470 Earth terminal
480 Data terminal
490 Mounting detection terminal
500 Ink cartridge
504*c* Light transmission surface
508 Substrate unit
600 Supply unit
602 Spring
604 Spring seat
606 Seal member
606*a* End
606*p* Center
L1 First terminal row
L2 Second terminal row
CA Virtual surface
CB Center line
SD Mounting direction
cp Contact portion

The invention claimed is:

1. A liquid container configured to be detachably mounted in a liquid consuming apparatus having a liquid acquisition needle, the liquid container having a bottom surface facing downward, a first side surface intersecting and extending upward from the bottom surface and facing in a first side direction, a second side surface opposite the first side surface, intersecting and extending upward from the bottom surface and facing a direction opposite the first side direction, the first side surface and second side surface defining a longitudinal direction from the first side surface toward the second side surface and a sideways direction perpendicular to the longitudinal direction, the liquid container comprising:

a liquid accommodating unit accommodating liquid in the liquid container;

a liquid supply unit formed on the bottom surface at a location closer to the first side surface than to the second side surface and having a liquid outlet that is configured to receive insertion of the liquid acquisition needle and permit liquid from the liquid accommodation unit to flow out of the liquid container;

a sealing unit formed on the bottom surface at a location closer to the first side surface than to the second side surface and in the vicinity of the liquid supply unit, the sealing unit configured to abut the liquid consuming apparatus when the liquid container is mounted therein;

an elastic member formed on the first side surface, configured to engage with the liquid consuming apparatus and to be biased in a direction from the first side surface toward the second side surface;

a contact portion which is located on the first side surface and adapted and configured to become electrically connected to the liquid consuming apparatus when the liquid container is mounted in the liquid consuming apparatus;

a prism having a light transmission surface located on the bottom surface at a position closer to the second side surface than to the first side surface, the prism adapted and positioned to receive light from the liquid consuming apparatus at the light transmission surface and to contact the liquid accommodated in the liquid accommodation unit;

a protrusion located on the bottom surface at a position closer to the second side surface than to the first side surface, the protrusion configured to contact the liquid consuming apparatus when the liquid container is mounted in the liquid consuming apparatus;

wherein the light transmission surface of the prism is located on the bottom surface at a position closer to the second side surface than to the liquid supply unit; and wherein the protrusion is located on the bottom surface at a position closer to the second side surface than to the light transmission surface of the prism.

2. The liquid container according to claim 1, further comprising a liquid communication channel having two ends, which is connected in fluid communication with the liquid accommodation unit and having a liquid port at one end and the liquid outlet at its other end.

3. The liquid container according to claim 2, further comprising a protrusion extends from the second side surface to contact the liquid consuming apparatus when the liquid container is mounted therein.

4. The liquid container according to claim 1, wherein the prism is a triangular prism having a ridge line formed at an apex thereof, the ridge line extending in the longitudinal direction, the prism configured and positioned such that a plane perpendicular to the bottom surface and intersecting the ridge line, intersects the center of the liquid outlet.

5. The liquid container according to claim 1, further comprising a pair of container side control units on the first side surface, adapted to position the contact portion at a selected location with respect to the liquid consuming apparatus, the control units located on both sides of the contact portion, with respect to the sideways direction;

wherein the contact portion has a contact surface having a plurality of container side terminals thereon, that are arranged in at least one row in the sideways direction and includes a first container side terminal at a position crossed by a central line of the contact surface with respect to the sideways direction; and the prism is a triangular prism formed with a ridge line at a prism apex, the ridge line extending along the longitudinal direction such that a plane perpendicular to the bottom surface and intersecting the ridge line will intersect the first container side terminal.

* * * * *